US009254037B2

(12) United States Patent
Benden

(10) Patent No.: US 9,254,037 B2
(45) Date of Patent: Feb. 9, 2016

(54) VERSATILE STUDENT DESK

(71) Applicant: Mark E. Benden, College Station, TX (US)

(72) Inventor: Mark E. Benden, College Station, TX (US)

(73) Assignee: THE TEXAS A&M UNIVERSITY SYSTEM, College Station, TX (US)

( * ) Notice: Subject to any disclaimer, the term of this patent is extended or adjusted under 35 U.S.C. 154(b) by 0 days.

(21) Appl. No.: 13/934,516

(22) Filed: Jul. 3, 2013

(65) Prior Publication Data

US 2014/0008943 A1 Jan. 9, 2014

Related U.S. Application Data

(60) Provisional application No. 61/667,561, filed on Jul. 3, 2012.

(51) Int. Cl.

| | |
|---|---|
| ***A47B 39/00*** | (2006.01) |
| ***A47B 39/04*** | (2006.01) |
| ***A47B 83/02*** | (2006.01) |
| ***A47C 1/00*** | (2006.01) |
| ***G09F 7/00*** | (2006.01) |
| ***G09F 7/18*** | (2006.01) |

(52) U.S. Cl.

CPC ..... *A47B 83/02* (2013.01); *A47B 39/00* (2013.01); *G09F 7/00* (2013.01); *G09F 7/18* (2013.01); *G09F 2007/1843* (2013.01); *G09F 2007/1856* (2013.01)

(58) Field of Classification Search

CPC ..... A47B 39/00; A47B 83/02

USPC ..... 297/172, 234, 235, 236, 237, 238, 331, 297/105, 423.11, 423.12; 40/320

See application file for complete search history.

(56) References Cited

U.S. PATENT DOCUMENTS

| | | | | | |
|---|---|---|---|---|---|
| 291,931 | A | * | 1/1884 | Piutti | 297/237 |
| 953,483 | A | * | 3/1910 | Miller | 297/237 X |
| 1,280,874 | A | * | 10/1918 | Scott | 297/172 |
| 1,319,236 | A | * | 10/1919 | Moyer | 297/172 |
| 1,355,681 | A | * | 10/1920 | McNulty | 297/172 |
| 1,367,908 | A | * | 2/1921 | Karschitz | 297/172 X |
| 1,568,211 | A | * | 1/1926 | Conwell | 297/172 |
| 1,731,375 | A | * | 10/1929 | Engers | 297/172 |
| 1,858,103 | A | * | 5/1932 | Menon | 297/172 X |
| 1,929,551 | A | * | 10/1933 | Hamilton | 297/172 X |
| 1,970,874 | A | * | 8/1934 | Yawman | 297/172 |
| 2,023,761 | A | * | 12/1935 | Drummey | 297/172 |
| 2,115,497 | A | * | 4/1938 | Mintz | 297/172 X |
| 2,140,635 | A | * | 12/1938 | Konarski | 297/172 |
| 2,673,595 | A | * | 3/1954 | Kump, Jr. | 297/172 |
| 2,732,007 | A | * | 1/1956 | MacWhriter | 297/172 |
| 2,894,561 | A | * | 7/1959 | MacKintosh | 297/172 |
| 3,477,673 | A | * | 11/1969 | Bereday | 297/423.1 |

(Continued)

*Primary Examiner* — Rodney B White

(74) *Attorney, Agent, or Firm* — Blank Rome, LLP

(57) ABSTRACT

A seat and desk assembly has a seat integrated with a desk by a interconnecting base and floor. One or both of the seat or desk can be disconnected from the assembly and used independently. Removable panels for the desk can be used to display information and hold replaceable placards for various purposes. The height of the seat and desk can be adjusted on the assembly, and the bottom rest of the seat can be pivoted up against the back to allow a user to stand on the floor as a standing platform with a lumbar support curve positioned for leaning support of the low-back while standing. The depth of the seat can also be adjusted relative to the desk to provide additional room for standing. Additionally, the tabletop of the desk may be able to slide fore-aft relative to the seated user.

17 Claims, 22 Drawing Sheets

(56) References Cited

U.S. PATENT DOCUMENTS

| | | | | | |
|---|---|---|---|---|---|
| 3,511,533 | A * | 5/1970 | Drabert | 297/337 |
| 3,770,334 | A * | 11/1973 | Weber | 312/223.4 |
| 4,046,419 | A * | 9/1977 | Schmitt | 297/153 |
| 4,050,491 | A * | 9/1977 | Hargrove | 297/188.2 |
| 4,248,476 | A * | 2/1981 | Phelps | 297/238 X |
| 4,382,643 | A * | 5/1983 | Heinrich | 312/195 |
| 4,383,486 | A * | 5/1983 | Reineman et al. | 108/2 |
| D283,563 | S * | 4/1986 | Arroyo | D6/338 |
| 4,736,998 | A * | 4/1988 | Wilson et al. | 297/140 X |
| 4,925,240 | A * | 5/1990 | Peters | 297/161 |
| 5,054,852 | A * | 10/1991 | Tholkes | 297/423.12 |
| 5,098,160 | A * | 3/1992 | Moore et al. | 297/174 R X |
| 5,149,174 | A * | 9/1992 | Charash | 297/423.12 |
| 5,186,519 | A * | 2/1993 | Larson | 297/423.12 |
| 5,199,763 | A * | 4/1993 | Wilder et al. | 297/338 |
| 5,255,957 | A * | 10/1993 | Opsvik et al. | 297/423.12 |
| 5,295,728 | A * | 3/1994 | Schaevitz | 297/423.12 X |
| 5,299,861 | A * | 4/1994 | Foliot et al. | 312/194 |
| 5,452,950 | A * | 9/1995 | Crenshaw et al. | 297/170 X |
| 5,542,746 | A * | 8/1996 | Bujaryn | 297/423.12 |
| 5,630,648 | A * | 5/1997 | Allard et al. | 297/327 |
| 5,667,278 | A * | 9/1997 | Li | 297/423.12 X |
| 5,685,602 | A * | 11/1997 | Williams | 297/174 R |
| 5,697,668 | A * | 12/1997 | Chao | 297/172 |
| 5,765,910 | A * | 6/1998 | Larkin et al. | 297/172 |
| 5,876,093 | A * | 3/1999 | Williams | 297/174 R |
| 5,884,935 | A * | 3/1999 | Tholkes | 280/657 |
| 6,010,186 | A * | 1/2000 | Tsay | 297/174 R X |
| 6,039,392 | A * | 3/2000 | Dencker | 297/172 |
| 6,109,686 | A * | 8/2000 | Fox | 297/105 |
| 6,186,589 | B1 * | 2/2001 | Burkamp | 297/142 |
| 6,439,657 | B1 * | 8/2002 | Tholkes | 297/172 |
| 6,516,731 | B1 * | 2/2003 | Park | 108/153.1 |
| D475,207 | S * | 6/2003 | Bosman et al. | D6/338 |
| 6,604,784 | B1 * | 8/2003 | Bosman et al. | 297/171 |
| 6,824,149 | B1 * | 11/2004 | Whitlock et al. | 280/32.6 |
| 6,899,391 | B1 * | 5/2005 | Schneller et al. | 297/252 |
| 7,048,332 | B1 * | 5/2006 | Dilling | 297/172 |
| 7,059,670 | B2 * | 6/2006 | Mills et al. | 297/170 X |
| 7,131,225 | B2 * | 11/2006 | Wu | 40/320 |
| 7,147,284 | B2 * | 12/2006 | Mills et al. | 297/271.5 |
| 7,192,084 | B1 * | 3/2007 | Huang | 297/172 |
| 7,252,336 | B2 * | 8/2007 | Frisina | 297/423.12 X |
| 7,293,825 | B2 * | 11/2007 | Vergara et al. | 297/423.11 X |
| 7,350,324 | B2 * | 4/2008 | Wu | 40/320 |
| D597,266 | S * | 7/2009 | Simpson et al. | D30/199 |
| 7,571,959 | B2 * | 8/2009 | Griepentrog | 297/172 |
| 7,614,639 | B2 * | 11/2009 | Tholkes et al. | 297/423.11 X |
| 7,681,346 | B2 * | 3/2010 | Bruce | 40/320 X |
| 7,954,892 | B2 * | 6/2011 | Knighton | 297/172 X |
| D649,368 | S | 11/2011 | Benden | |
| D649,369 | S | 11/2011 | Benden | |
| 8,220,872 | B2 * | 7/2012 | Hong | 297/312 |
| 8,317,267 | B2 * | 11/2012 | Wallace | 297/423.11 X |
| 8,757,727 | B2 * | 6/2014 | Leclaire | 297/172 X |
| 8,801,638 | B2 * | 8/2014 | Gierse | 297/423.11 X |
| 2002/0149168 | A1 * | 10/2002 | Brown | 280/250.1 |
| 2002/0167205 | A1 * | 11/2002 | Tholkes et al. | 297/172 |
| 2003/0151288 | A1 * | 8/2003 | Deisig | 297/313 |
| 2004/0251720 | A1 * | 12/2004 | Micheletti | 297/228.1 |
| 2006/0097557 | A1 * | 5/2006 | Tholkes et al. | 297/330 |
| 2007/0182222 | A1 * | 8/2007 | Griepentrog | 297/172 |
| 2009/0140567 | A1 * | 6/2009 | Weiss | 297/423.12 |
| 2009/0178596 | A1 * | 7/2009 | Skiba | 108/102 |
| 2009/0186747 | A1 * | 7/2009 | Lokken et al. | 482/51 |
| 2010/0007180 | A1 * | 1/2010 | Ovre et al. | 297/68 |
| 2010/0066148 | A1 * | 3/2010 | Matthews | 297/423.12 |
| 2012/0000102 | A1 * | 1/2012 | Bruce | 40/320 |
| 2012/0274117 | A1 * | 11/2012 | Preisler | 297/452.1 |

* cited by examiner

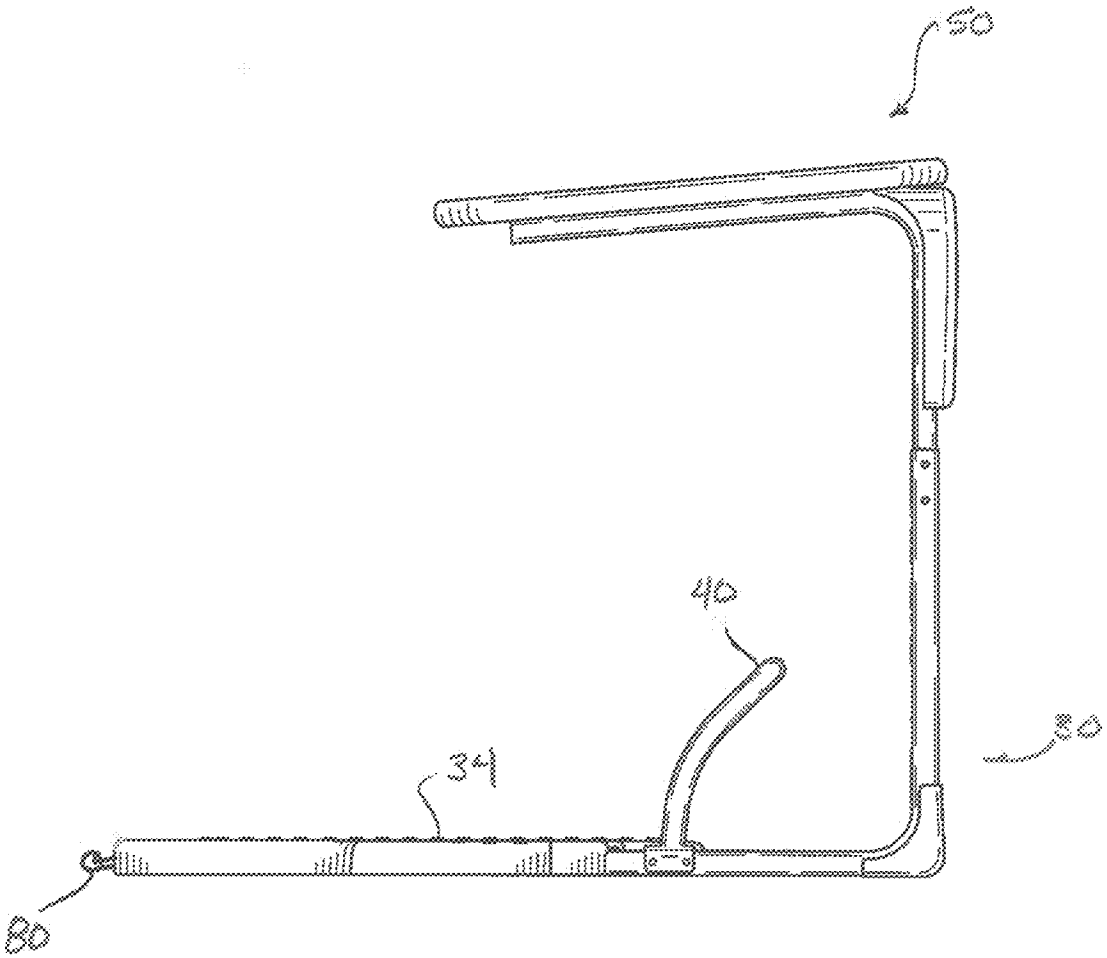
FIG. 3D
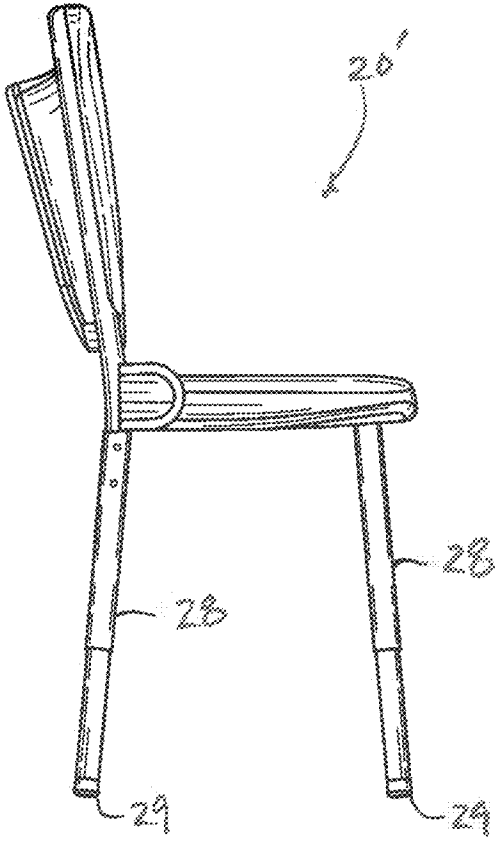

VERSATILE STUDENT DESK

CROSS-REFERENCE TO RELATED APPLICATION

This application claims the benefit of U.S. Provisional Appl. 61/667,561, filed 3 Jul. 2012, which is incorporated herein by reference in its entirety.

BACKGROUND OF THE DISCLOSURE

Overall goals for an educational setting include increasing students' attention, improving their overall learning, and enhancing their physical activity. To meet these goals, it can be desirable to have student desks that are aesthetically pleasing, such as the ornamental designs disclosed in my U.S. Design Pats. D649,368 entitled "Student Desk with Seat" and D649,369 entitled "Student Desk with Stool," which are both incorporated herein by reference in their entireties.

As any teacher can appreciate, however, students can be very active in the classroom, and it is equally desirable to have desks and seats that can suit students' active needs. To that end, ergonomics, adjustability, versatility, and other functional and structural features can be important in meeting educational goals and in making student desks more useful in an educational setting.

BRIEF DESCRIPTION OF THE DRAWINGS

FIG. 2A-2 illustrates a sectional view of one embodiment of a pin and slot mechanism for the adjustable footrest in FIG. 2A-1.

FIG. 2B-1 illustrates a portion of the base of the disclosed desk assembly having another adjustable footrest.

FIG. 2B-2 illustrates a sectional view of one embodiment of a pin and slot mechanism for the adjustable footrest in FIG. 2B-1.

FIG. 3D illustrates the seat removed from the integrated base and desk of the desk assembly in FIGS. 3A-3C.

DETAILED DESCRIPTION OF THE DISCLOSURE

A versatile student desk assembly has a seat integrated with a desk by an interconnecting base. One or both of the seat and desk can be disconnected from the assembly and used independently. Removable panels for the desk can be used to display information and hold replaceable placards for various purposes. The height of the seat and the desk can be adjusted on the assembly, and the bottom rest of the seat can be pivoted up against the seat back to allow a user to stand on the floor as a standing platform. The depth of the seat can be adjusted relative to the desk to provide additional room for standing, and the depth of a footrest can be adjusted relative to the seat to provide additional leg room.

A. Information Panels

Figure 1A:
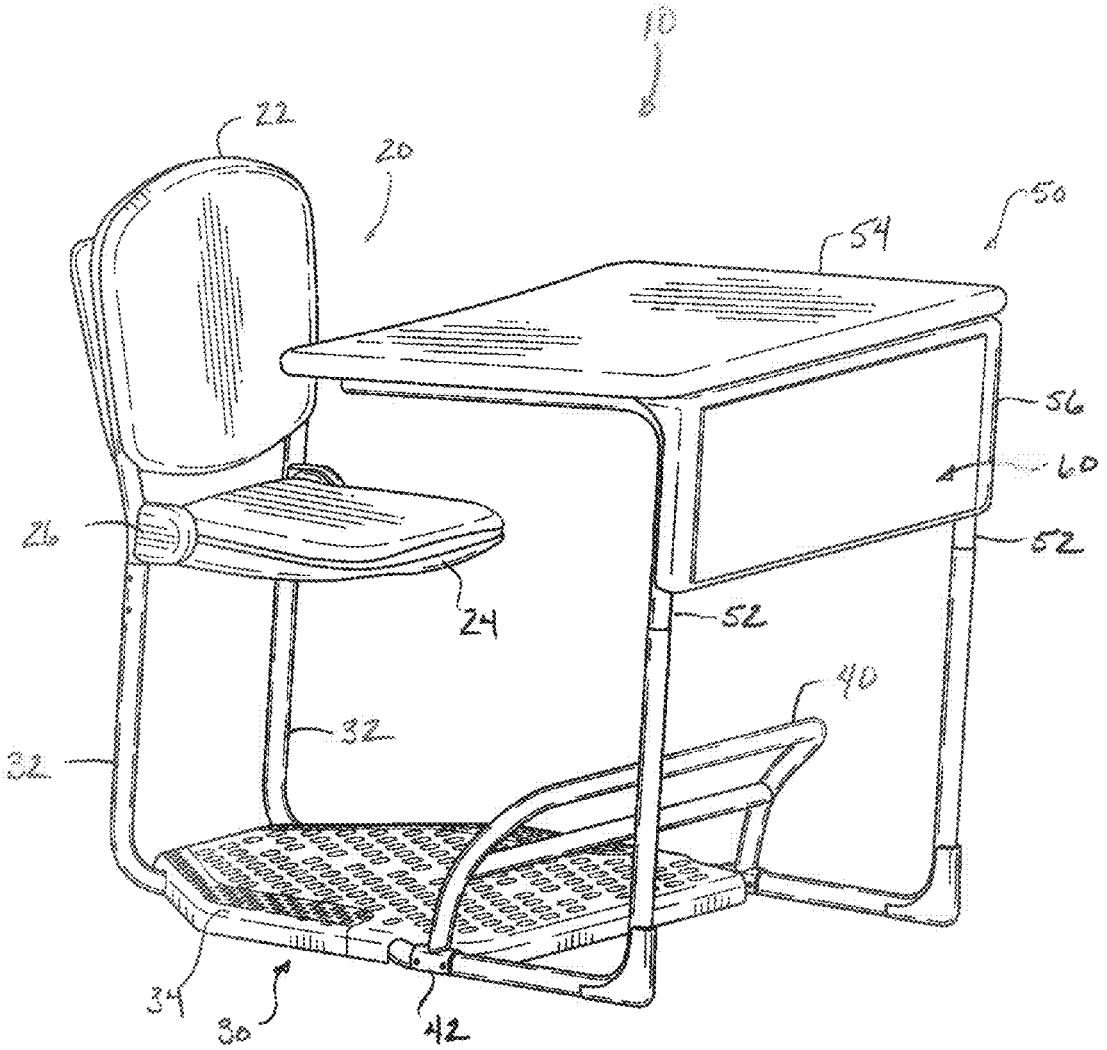
FIGS. 1A-1C illustrate perspective, front, and side views of an integrated desk assembly of seat, base, and desk having an information panel according to one embodiment of the present disclosure.
Figure 1B:
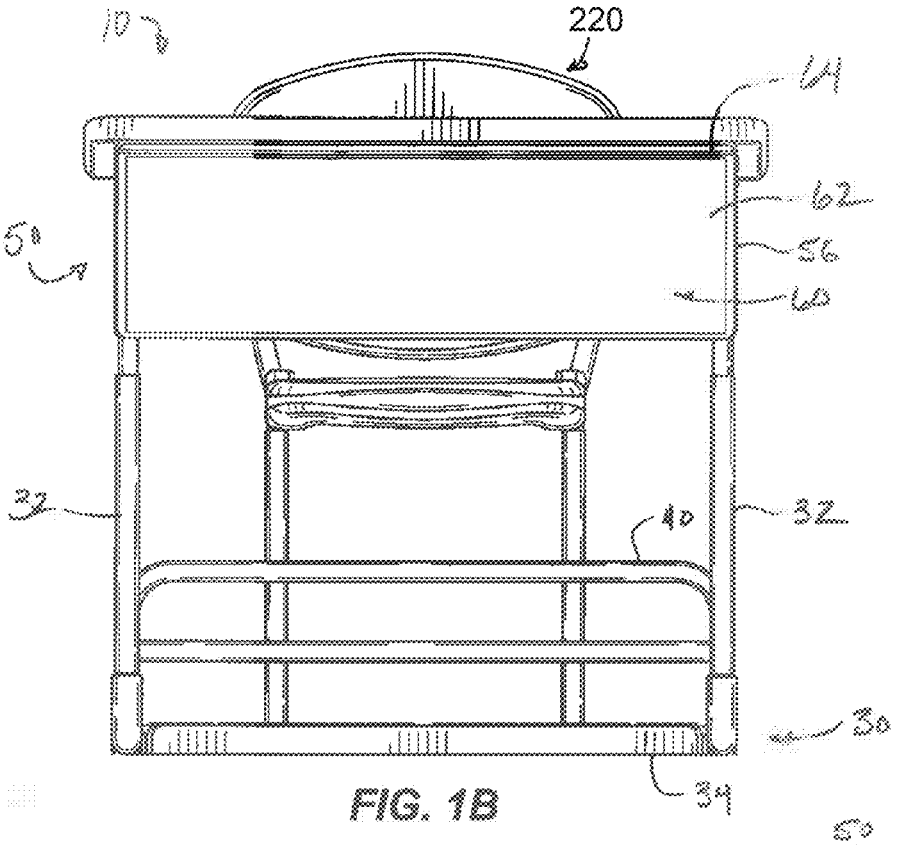
Figure 1C:
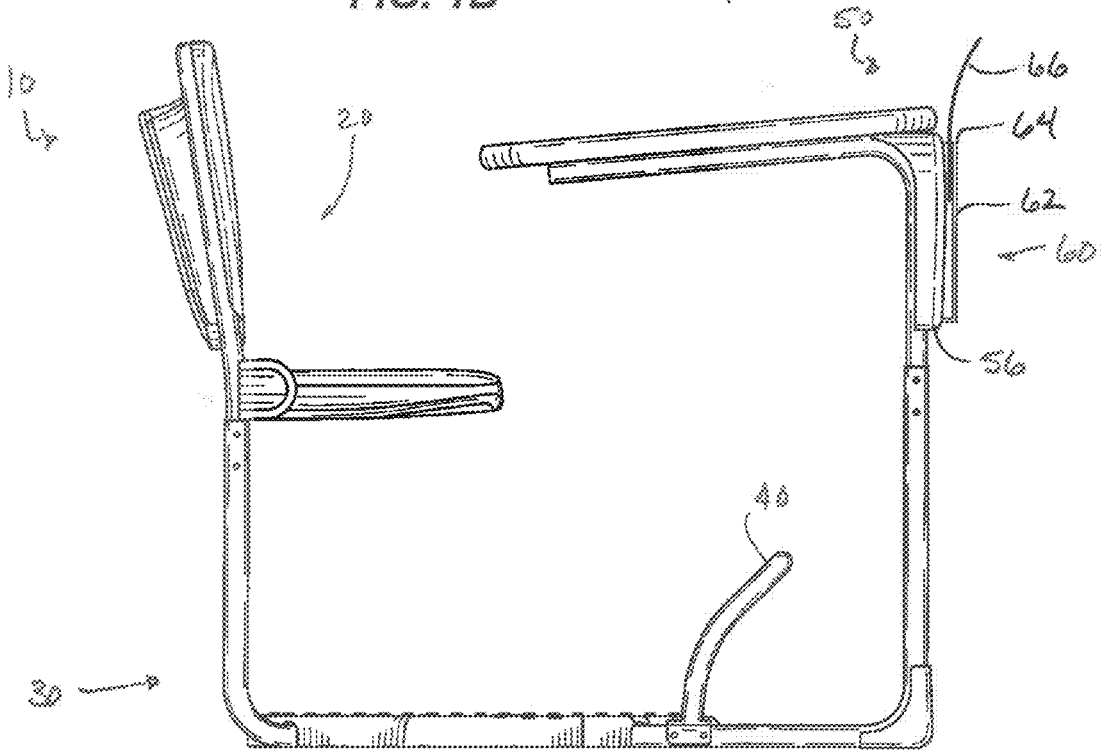

FIGS. 1A-1C illustrate perspective, front, and side views of an integrated desk assembly 10 according to one embodiment of the present disclosure. The assembly 10 has a seat 20 integrated by a base 30 to a desk 50 so that the assembly 10 operates as a single unit for use by students or the like.

The seat 20 has a back rest 22 connected to frame members 32 of the base 30. A bottom rest 24 of the seat 20 connects to the back rest 22 with attachment mechanisms 26, which as described below can be hinges used to pivot the bottom rest 24 up against the back rest 22.

The base 30 has a platform or floor 34 disposed on top of the frame members 32, and a footrest 40 connects via open joints 42 to the frame members 32 toward the front end of the floor 34. Finally, the desk 50 has supports 52 connected to the base's frame members 32. A tabletop 54 and privacy screen 56 affix to the supports 52 to complete the desk 50.

As shown, the assembly 10 has a removable placard or panel 60 that affixes to the front of the privacy screen 56 on the desk 50. The panel 60 can be used to communicate various forms of useful information for classrooms and other settings. For example, the panel 60 can be used for seating information, personal information, grading or assignment details, advertisements, logos, and other forms of information. The panel 60 can be pre-printed with information, or users, such as elementary students, can decorate or write on the panels 60. In general, the panel 60 can affix to the screen 56 using a variety of attachment methods and materials—some of which are described below.

As shown in FIG. 1C, for example, the panel 60 includes a frame 62 attached to the screen 56. The frame 62 defines a slot 64 along one edge and forms a pocket for holding a removable placard 66. The frame 62 can be made of plastic or metal. As clear plastic, for example, the frame 62 can define a full slotted enclosure for holding the placard 66. Alternatively, the frame 62 can be composed of a metallic slotted frame that is open in the middle to display the placard 66. For its part, the placard 66 can be composed of any suitable material, such as Tyvek® material, fabric, metal, solid or clear plastic, paper, etc. (TYVEK is a registered trademark of E. I. DU PONT DE NEMOURS AND COMPANY CORPORATION.)

Figure 1E:
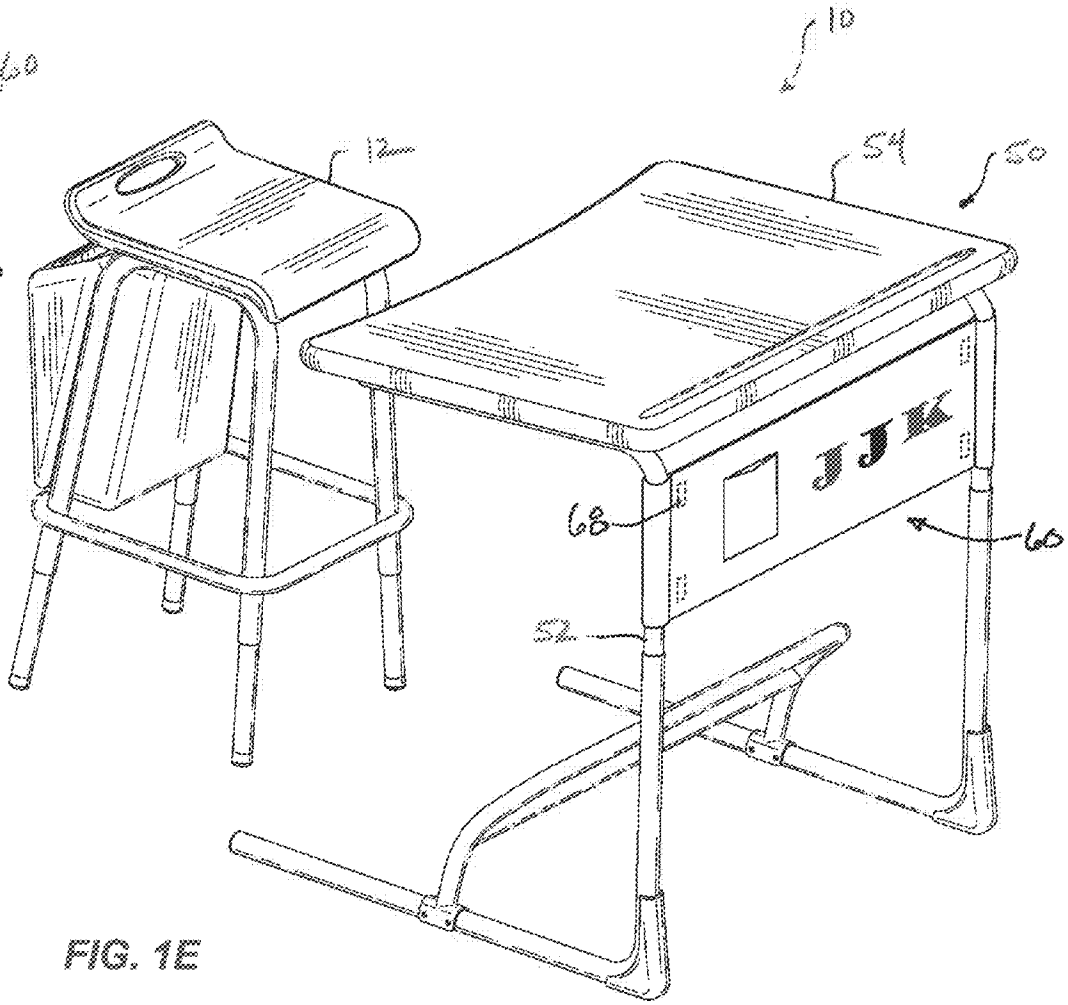
FIG. 1E illustrates a perspective view of a desk assembly having a stool and having a desk with an information panel according to the present disclosure.
Figure 1D:
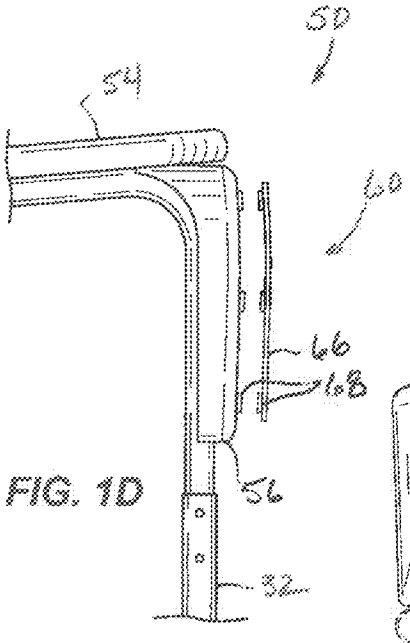
FIG. 1D is an alternative embodiment of an information panel for the disclosed desk assembly.

As shown in another example of FIG. 1D, the panel 60 includes a placard 66 that affixes directly to the screen 56 using attachments 68, which can include glue, hook and loop fasteners, magnets, snaps, buttons, or any other permanent or removable fastening mechanisms.

Figure 1F:
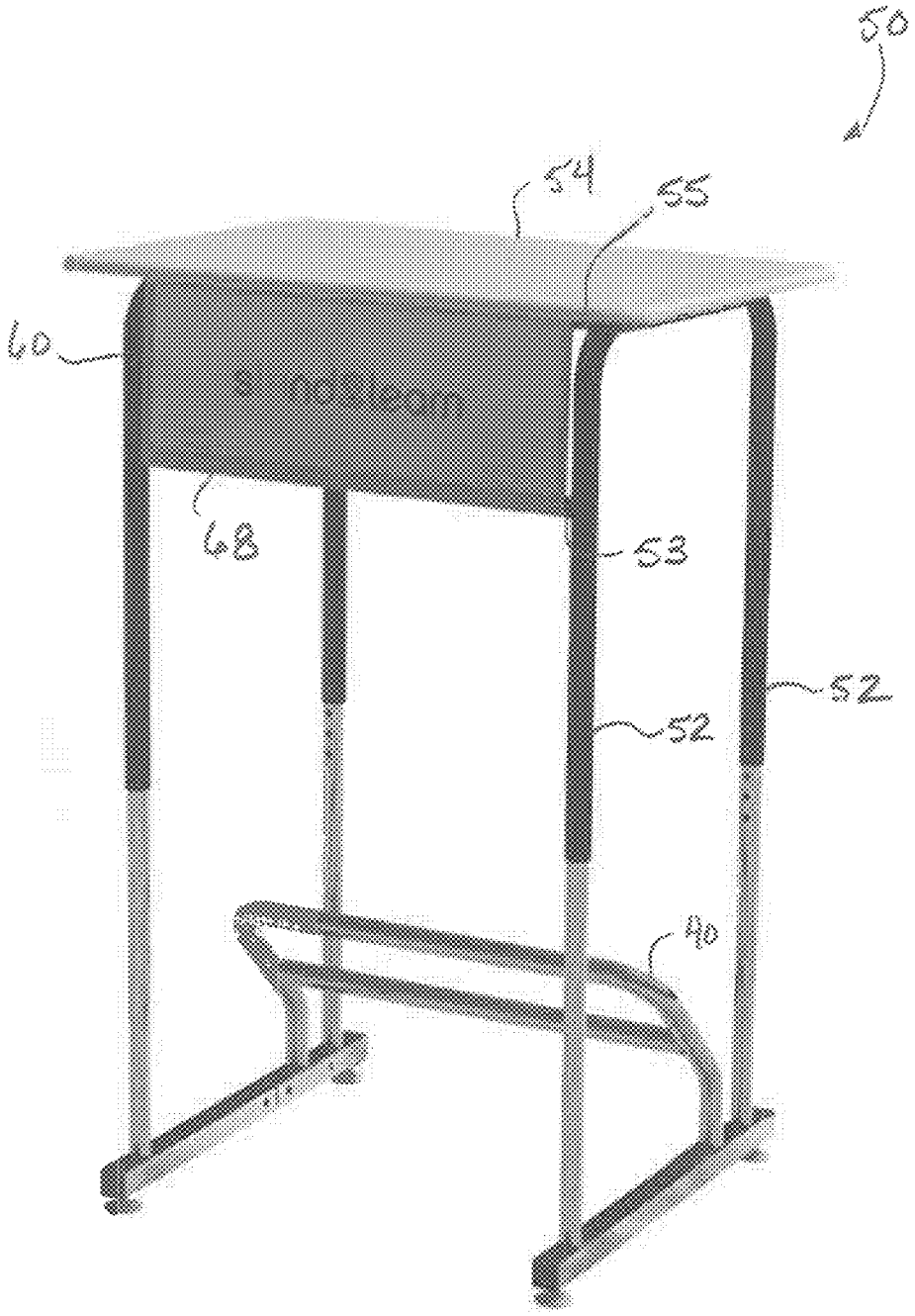
FIG. 1F illustrates another desk assembly having an alternative information panel according to the present disclosure.

As shown in yet another example of FIG. 1E, the panel 60 can affix at its ends to the vertical supports 52 on the desk 50. In this arrangement, the panel's ends can affix to the supports 52 using a variety of attachments 68, such as welds, glue, hook and loop fasteners, magnets, snaps, buttons, or any other permanent or removable fastening mechanisms. As shown in FIG. 1F, the panel 60 can alternatively affix along its top edge to the underside of the desk surface 54, for example, at an upper cross support 55. Additionally, the panel 60 can affix along its bottom edge to a cross bar 53 between the desk's supports 52.

In either case, the panel 60 in the arrangements of FIGS. 1E-1F can actually operate as a security screen for the desk's user so that the desk 50 depicted in FIGS. 1E-1F is missing a permanent security screen as in other arrangements. Additionally, the panel 60 may itself incorporate the information to be communicated or may act as a holder via a pocket or the like of printed or written information to be communicated to or about a student.

B. Foot Rest Adjustment

As shown in FIGS. 1A-1C, the footrest 40 has two rails, one providing support when standing and one for providing support when seated. The footrest 40 can be adjusted for depth relative to the user by using screws or fasteners that affix the joints 42 to set locations on the base's frame members 32.

Figures 1, 2A:
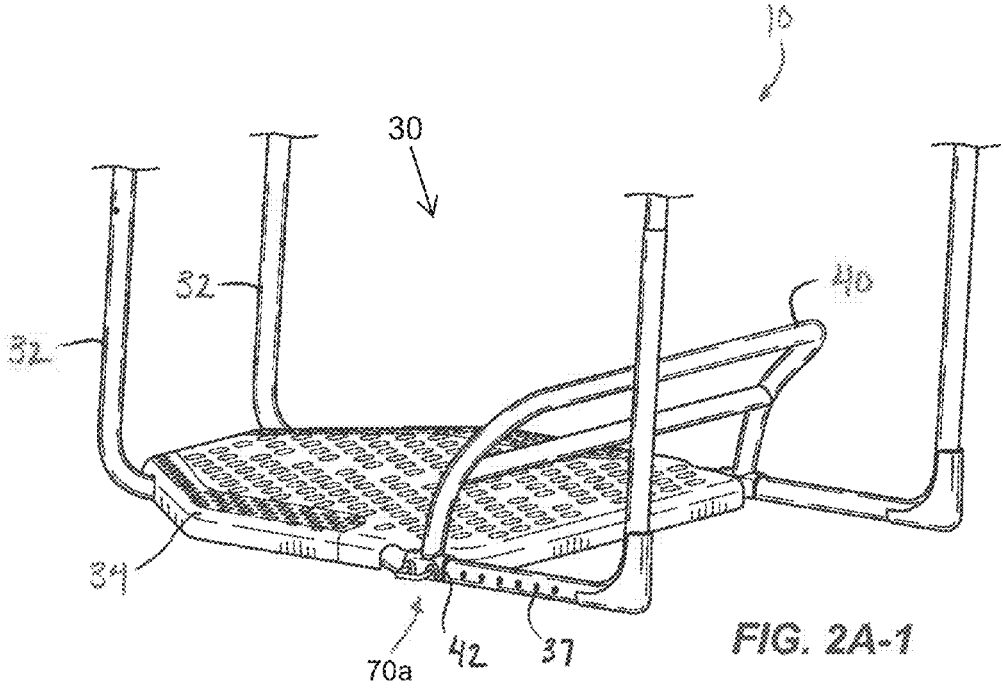
FIG. 2A-1 illustrates a portion of a base of the disclosed desk assembly having an adjustable footrest.
Figures 2, 2A:
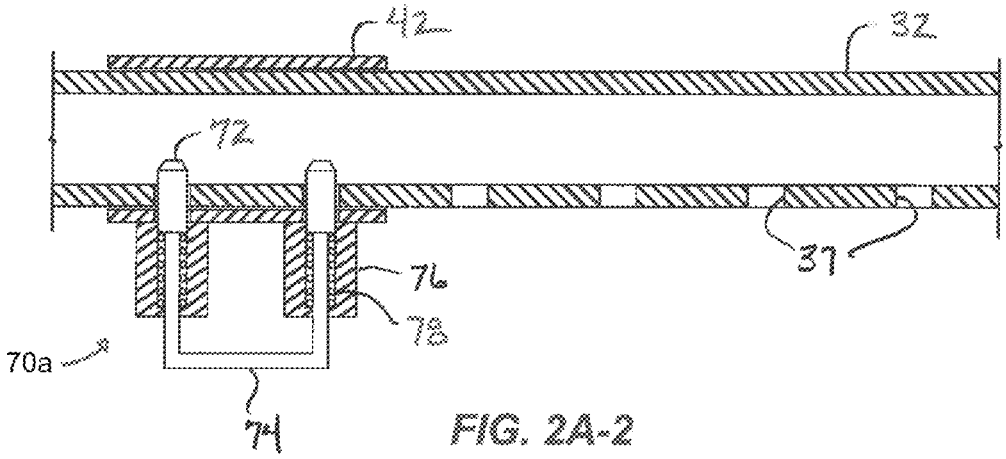

As an alternative shown in FIGS. 2A-1 and 2A-2, footrest adjustment for depth (relative to the user) can be accomplished using removable pins and latch points of a lock mechanism 70*a*. FIG. 2A-1 illustrates a portion of a base 30 of the disclosed assembly 10 having one such adjustable footrest 40, and FIG. 2A-2 illustrates a sectional view of one embodiment of a pin and latch mechanism 70*a* for the adjustable footrest 40 in FIG. 2A-1.

The mechanism 70*a* has one or more pins 72 that can pass into and out of latch points or holes 37 in the frame member 32. Preferably, the one or more pins 72 attach to a handle 74 that can be easily accessed. To facilitate pulling out the pins 72 and inserting them in new latch points 37, the pins 72 are preferably biased by springs 78, which can be enclosed in housings 76 and can bias the pins 72 for insertion.

To adjust the location of the joint 42 on the frame member 32 and thereby move the footrest 40, a user can pull the handle 74 to release the pins 72 from the latch points 37 and slide the footrest 40 along the frame member 32. Once at the desired location, the pins 72 can be released to insert into new latch points 37.

Figures 1, 2B:
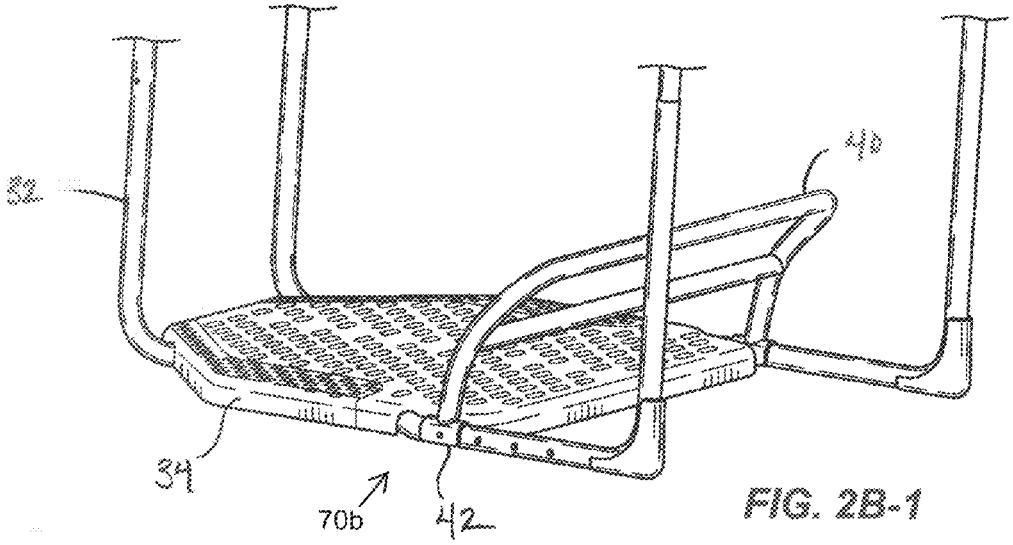
Figures 2, 2B:
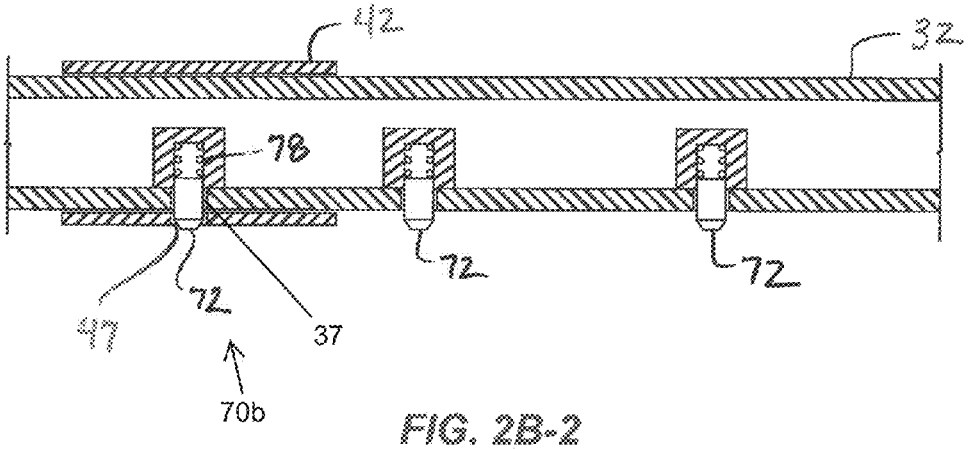

As another alternative shown in FIGS. 2B-1 and 2B-2, footrest adjustment for depth (relative to the user) can be accomplished using a push-button lock mechanism 70*b*. FIG. 2B-1 illustrates a portion of a base 30 of the disclosed assembly 10 having one such adjustable footrest 40, and FIG. 2B-2 illustrates a sectional view of one embodiment of a biased button mechanism 70*b* for the adjustable footrest 40 in FIG. 2B-1.

The mechanism 70*b* has push-buttons 72, which can be biased by springs 78 or the like. The push-buttons 72 pass through holes 37 in the frame member 32 and can pass into and out of a hole 47 in the joint 42 when disposed relative thereto. To adjust the location of the joint 42 on the frame member 32 and thereby move the footrest 40, a user can push the locked push-button 72 inward, slide the footrest 40 along the frame member 32, and push any other push-buttons 72 inward, if necessary. The footrest 40 can then be locked in place by locking one of the push-buttons 72 in the joint's hole 47.

Figure 2C:
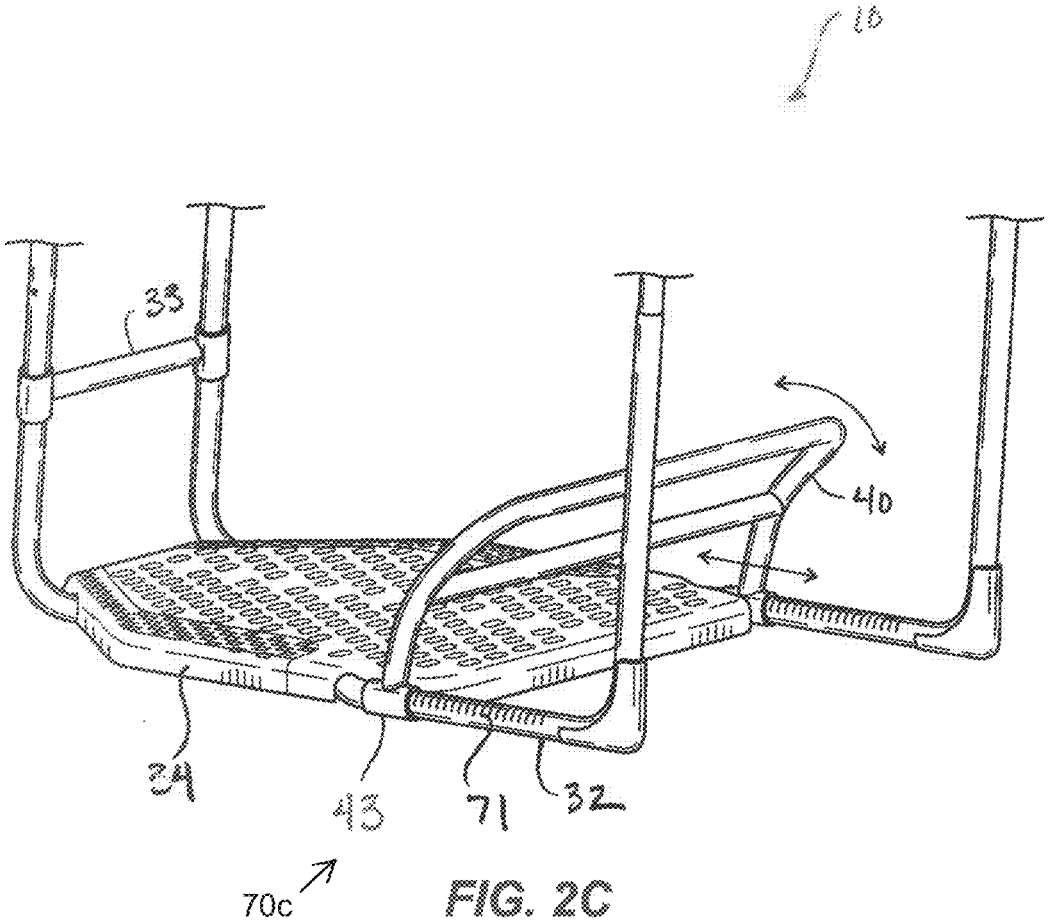
FIG. 2C illustrates a portion of the base of the disclosed assembly having yet another adjustable footrest.

FIG. 2C shows another mechanism 70*c* for adjusting the position of the footrest 40. Here, the joints 43 on the footrest 40 are tubes disposed on the frame members 32, which is a horizontal tube. The tubular joints 43 can slide along the tubular frame members 32 when foot pressure is absent so the position of the footrest 40 can be adjusted. Yet, when foot pressure is applied against the rest 40, the tubular joints 43 hold their position on the tubular frame members 32 due to the friction from the cantilever pressure of the encapsulating joints 43 against the frame members 32. This action locks the joints 43 in place. Cross-grooves, knurling, notches, or the like 71 can be applied to the surface of the tubular frame members 32 to enhance this cantilever locking.

C. Disconnectable Desk and Seat

As shown in FIGS. 1A-1C, the base's floor 34 can integrated into the seat 20 and the desk 50. This construction can prevent inadvertent and distracting movement of the seat 20 and desk 50 when used in a classroom setting. In other embodiments, one or both of the seat 20 and desk 50 may be removable from the frame 30 to provide more versatility to the assembly 10.

Figure 3A:
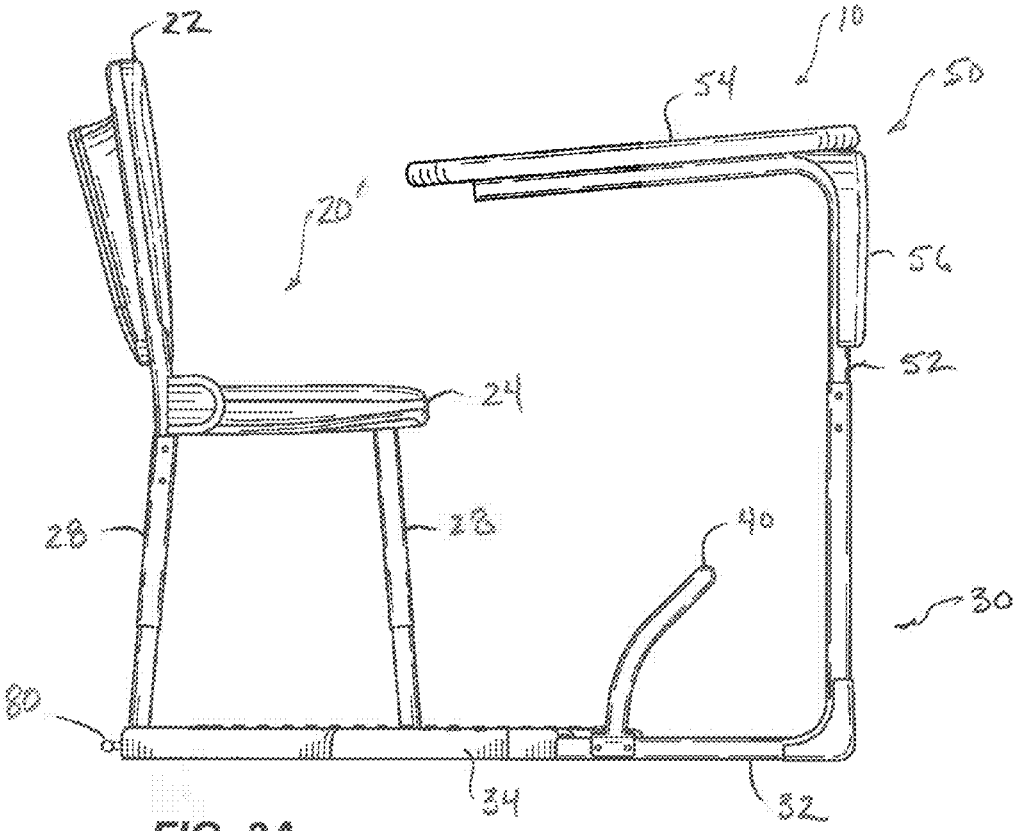
FIGS. 3A-3C illustrate side, back, and bottom views of an embodiment of a desk assembly having a seat removable from an integrated base and desk.
Figure 3B:
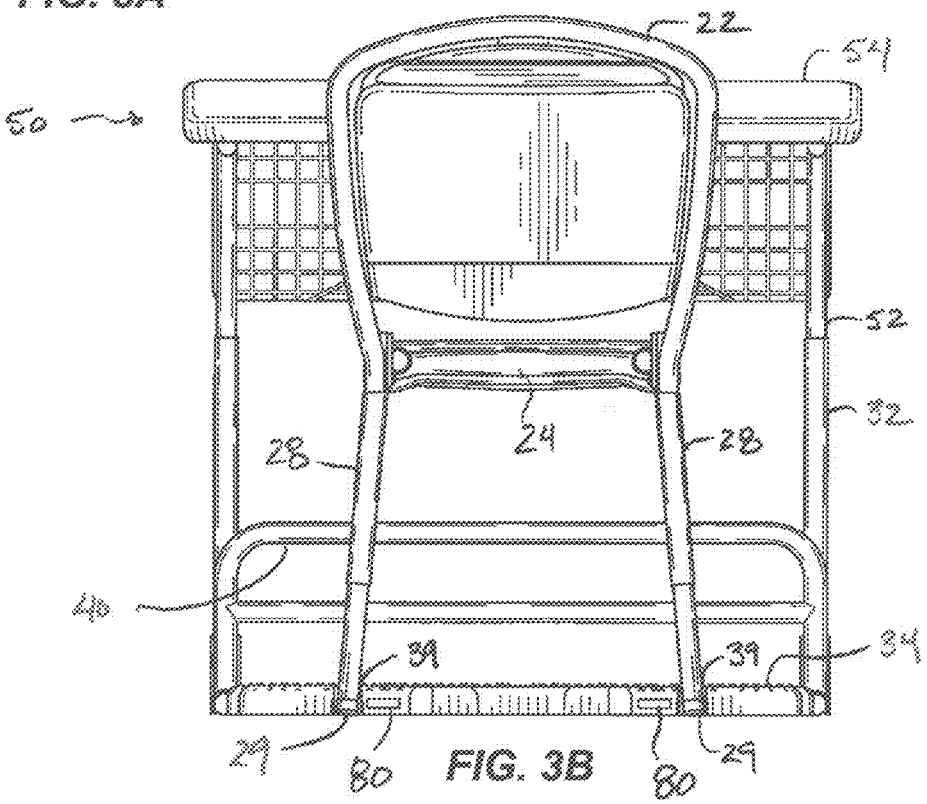
Figure 3C:
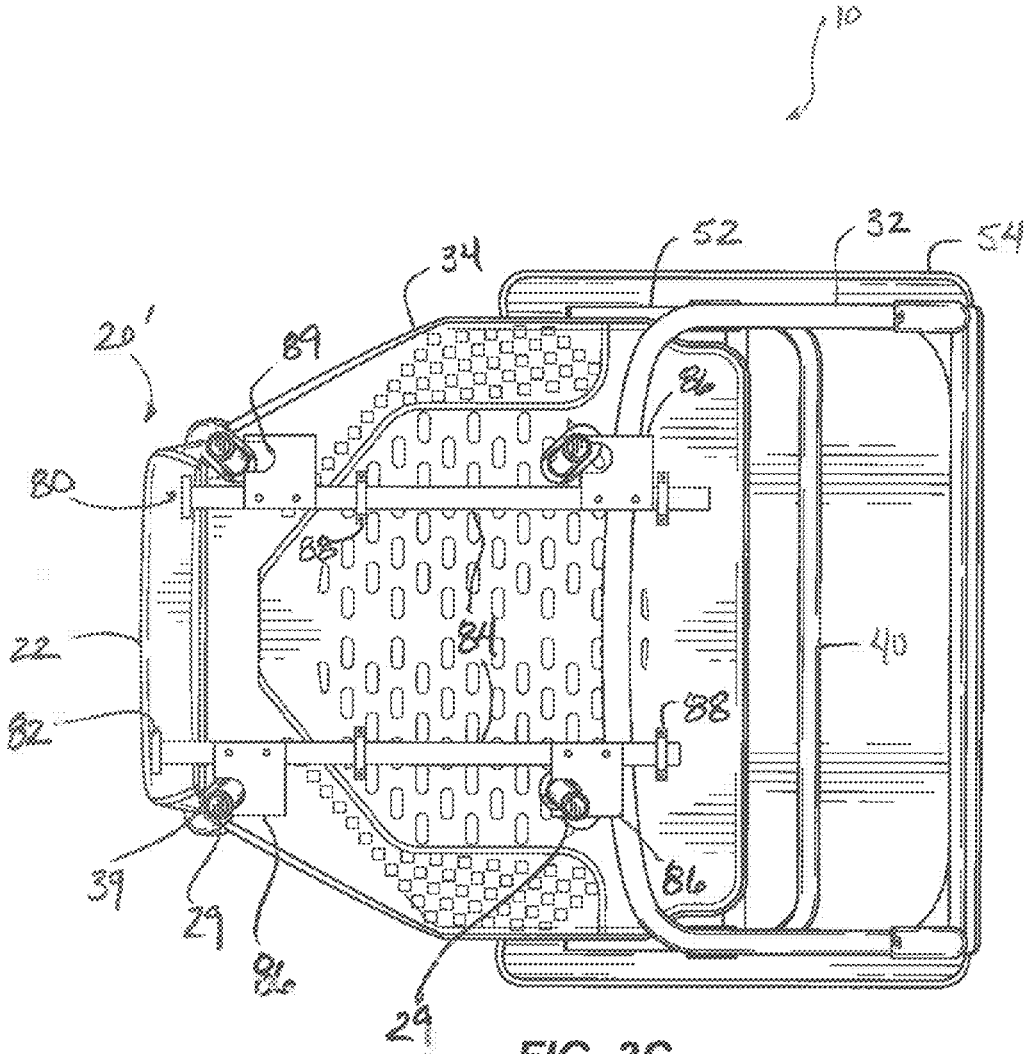

Turning to FIGS. 3A-3C, for example, an embodiment of the desk assembly 10 has a desk 50 and seat 20 integrated into the base 30, but the seat 20 is removable from the base 30 so it can be used independently. The seat 20, base 30, footrest 40, and desk 50 are similar to those discussed above so that like reference numerals are used. However, the seat 20 has multiple (e.g., four) legs 28 and can be used independent from the base 30.

The legs 28 fit onto the base 30 and can be held in place using a lock mechanism 80—the details of which are discussed later. As best shown in FIG. 3C, the feet 29 of the seat's legs 28 fit through openings 39 in the base's floor 34. Because the legs 28 are preferably angled to better support weight and provide stability, these openings 39 can be oblong, and the openings 39 near the back edge of the floor 34 may actually be open at one end.

With the feet 29 positioned in the openings 39 of the base's floor 34, the seat 20 is essentially integrated with the base 30 and desk 50 to form the integrated desk assembly 10. Yet, when desired, the seat 20 can be lifted from the base 30 to remove the feet 29 from the openings 39. At that point, the seat 20 can be used independently from the base 30 and desk 50 as depicted in FIG. 3D.

As noted above, the feet 29 of the seat 20 can be held on the base 30 using a locking mechanism 80. One example of the locking mechanism 80 is best shown in FIG. 3C. As shown, the mechanism 80 includes a sliding bar 84 having a handle 82 at one end extending beyond or out of the back edge on the base's floor 34. Couplers 88 hold the sliding bar 84 to the underside of the floor 34 and allow the bar 84 to be moved along its length. Near the oblong openings 39 in the floor 34, the bar 84 has locks or catches 86. When the bar 84 is slid in one direction (e.g., away from the desk 50), the catches 86 engage the feet 29 on the seat's legs 28. When the bar 84 is slid in the opposite direction (e.g., toward the desk 50), the catches 86 disengage the feet 29 so they can be lifted out of the openings 39. A reverse arrangement may instead be used. This and other mechanisms can be used to engage and hold the feet 29 or legs 28 of the seat 20 to the base 30.

Figure 4A:
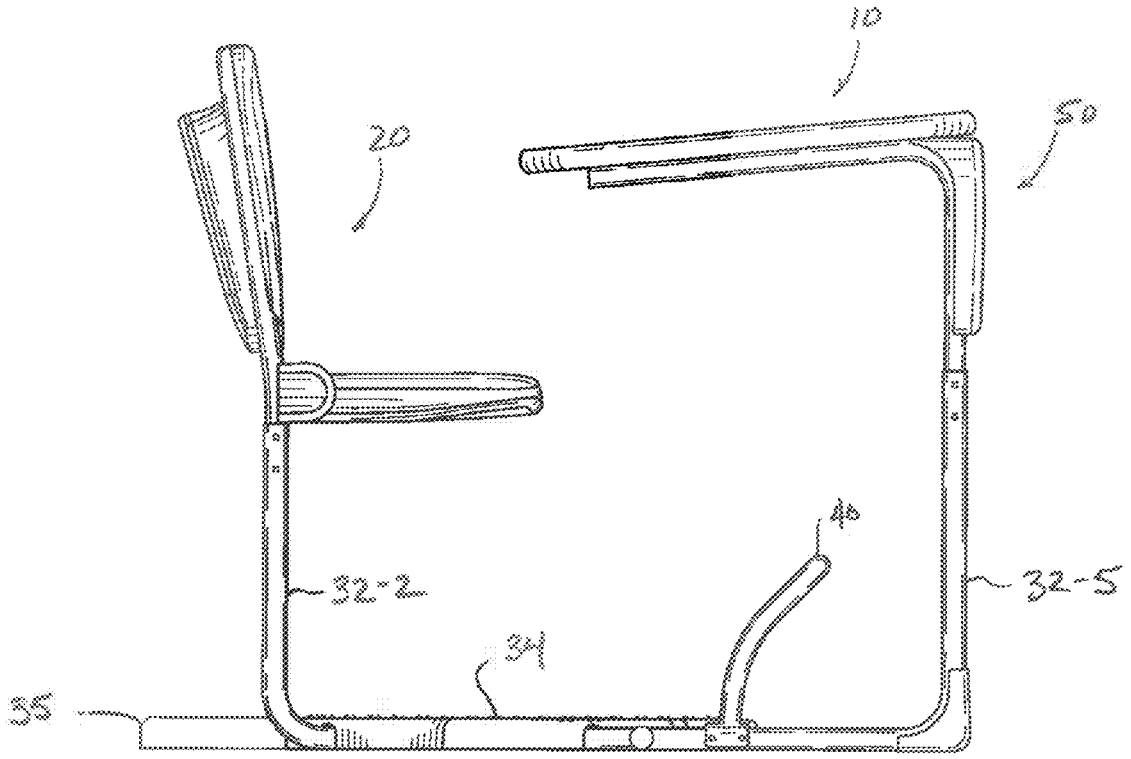
FIGS. 4A-4B illustrate side and bottom views of another embodiment of a desk assembly having a seat removable from an integrated base and desk.
Figure 4B:
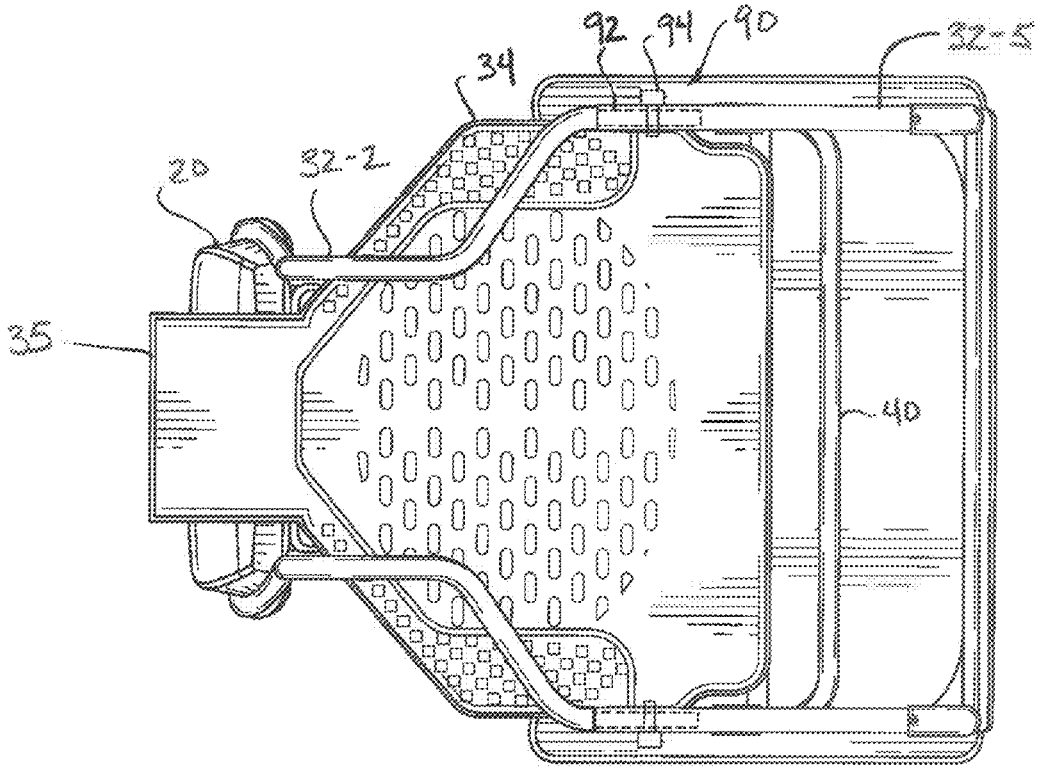

Turning now to FIGS. 4A-4B, an embodiment of the desk assembly 10 has a desk 50 and seat 20 integrated into the base 30, but the desk 50 is removable from the base 30 so it can be used independently. The seat 20, base 30, footrest 40, and desk 50 are similar to those discussed above so that similar reference numerals are used. However, each of the frame members 32 of the base 30 are split into separate components—one member 32-2 for the seat 20 and another 32-5 for the desk 50.

The ends of these members 32-2 and 32-5 abut one another, and lock mechanisms 90 hold them together. This keeps the desk 50 attached to the integrated seat 20 and base 30 of the assembly 10. As best shown in FIG. 4B, the lock mechanisms 90 include bars 92 that extend from the frame members (e.g., 32-2) and fit into the hollow tubing of the other frame members (e.g., 32-5). A reverse arrangement could also be used.

Figure 5A:
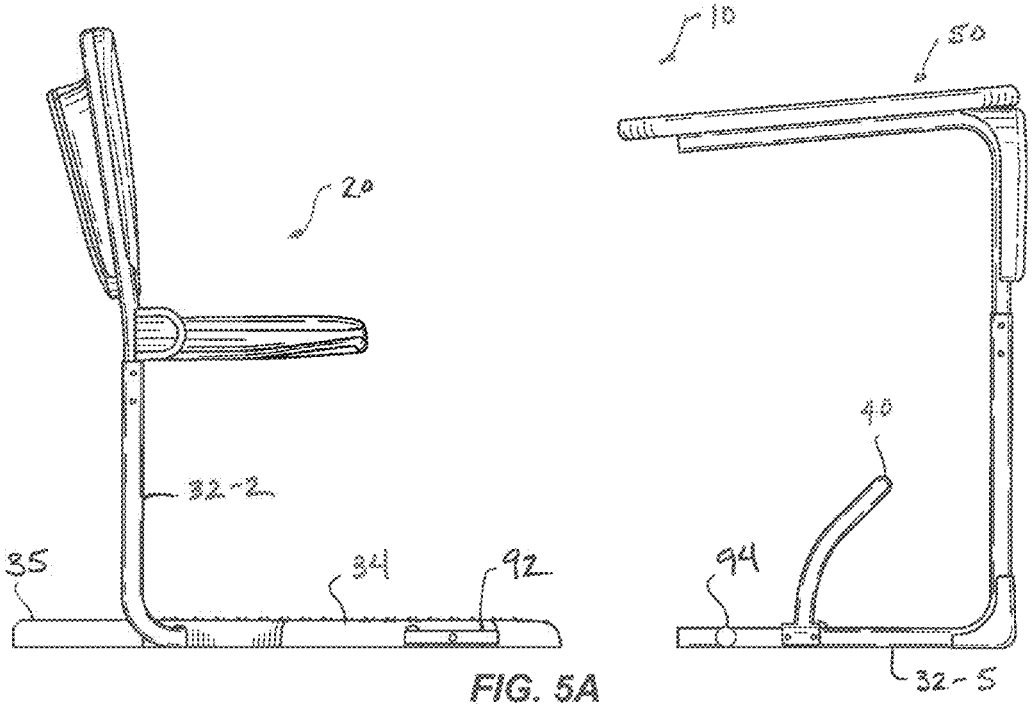
FIGS. 5A-5B illustrate side and bottom views of the seat removed from the integrated base and the desk in FIGS. 4A-4B.
Figure 5B:
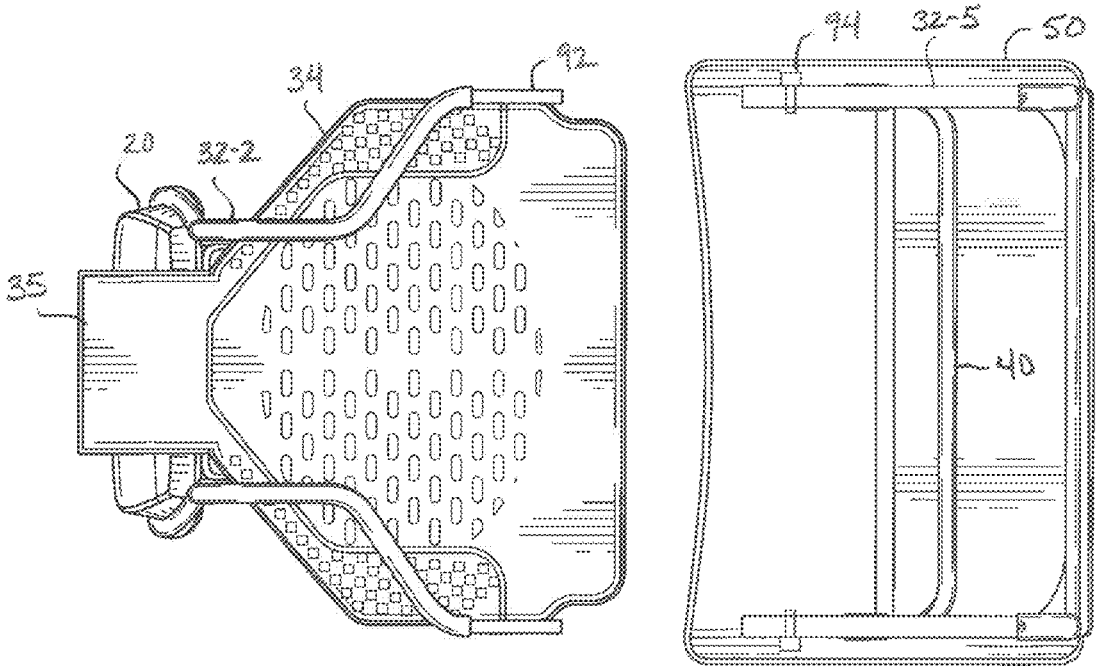

Either way, threaded fasteners or pins 94 install through the surrounding members 32-5 and into the extending bars 92 to hold the desk 50 to the base 30. When desired, however, the lock mechanisms 90 can be unfastened, and the desk 50 can be slid away from the base 30 to remove the desk 50 from the assembly 10. At that point as shown in FIGS. 5A-5B, the desk 50 can be used independently from the base 30 and seat 20, which can also be used independently. For stability and depending on the size of the floor 34 and the distribution of weight, the floor 34 may require an extension 35 beyond the back of the seat 20 to prevent tipping backwards if the seat 20 and base 30 are used without the desk 50. Rather than an extension 35 to the floor 34, other features, such as legs, bars, feet or the like can be disposed at the back edges of the frame members 32-2 to prevent the seat 20 and base 30 from tilting back.

Figure 6B:
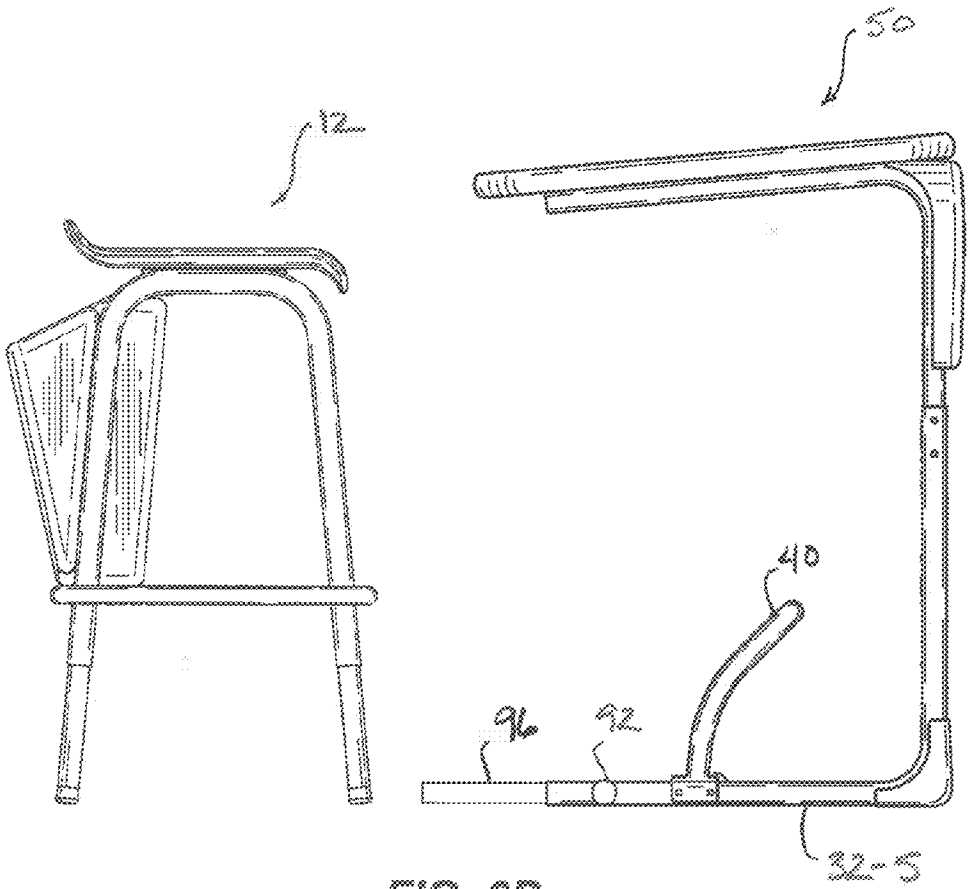
FIGS. 6A-6B illustrate the desk of FIGS. 5A-5B used alone and used with a stool.
Figure 6A:
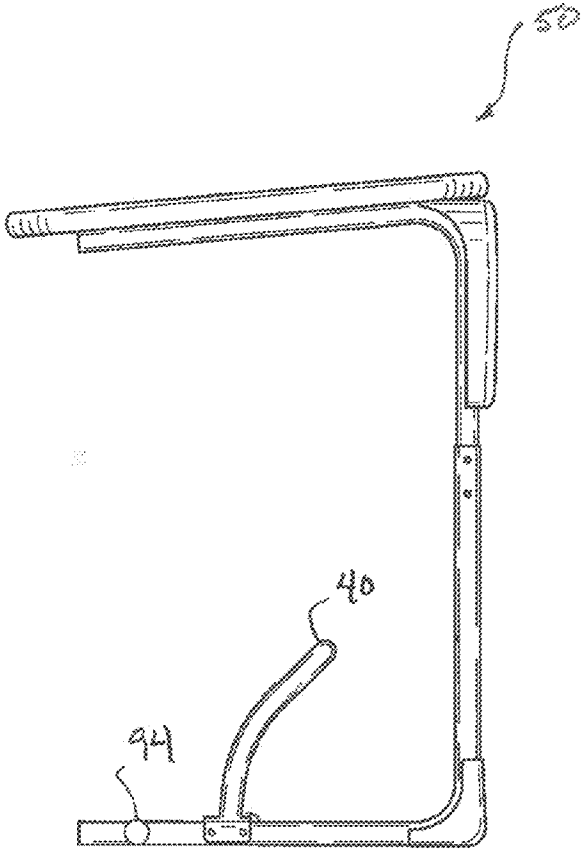

As shown in FIGS. 6A-6B, the desk 50 can be used independently or can be used with another seat or stool 12. As also shown, the desk 50 may use extending feet 96 that affix in the tubes of the frame members 32-5 with the lock mechanisms 90, or these extending feet 96 may actually be the existing bars of the lock mechanisms 90. The feet 96 may be used depending on the stability of the desk 50 once removed from the base 30.

Figure 7A:
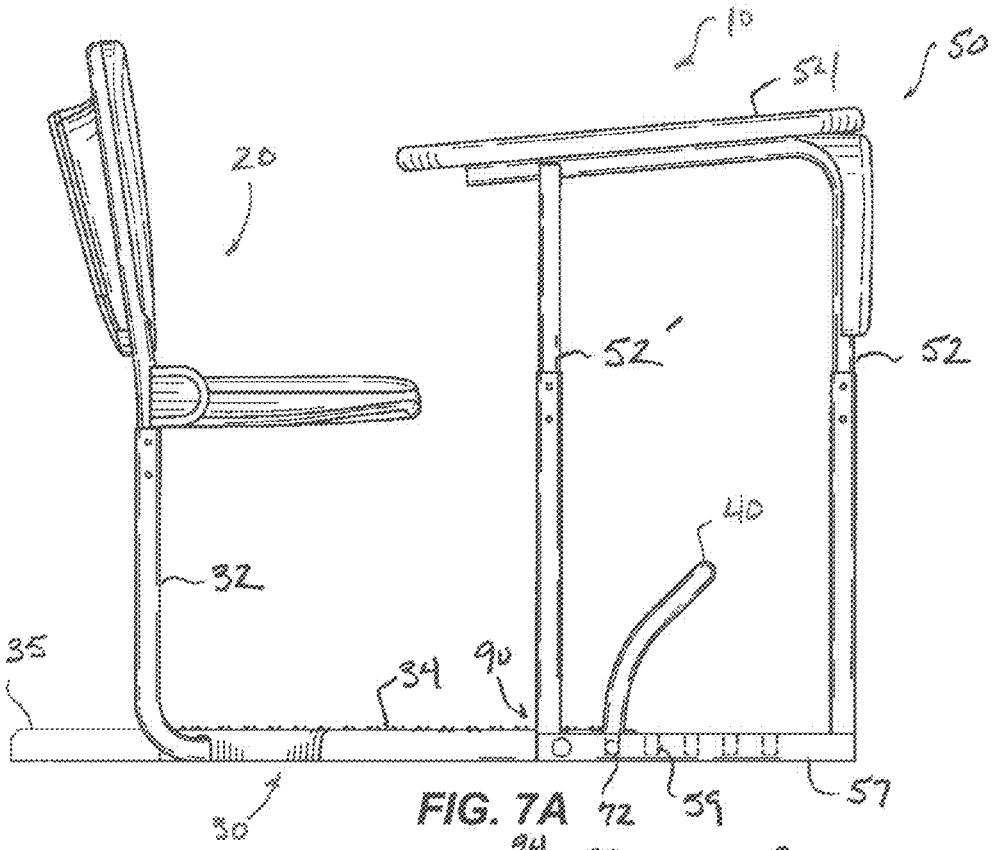
FIGS. 7A-7B illustrate side and bottom views of a desk assembly with a desk removable from an integrated base and seat of the assembly.
Figure 7B:
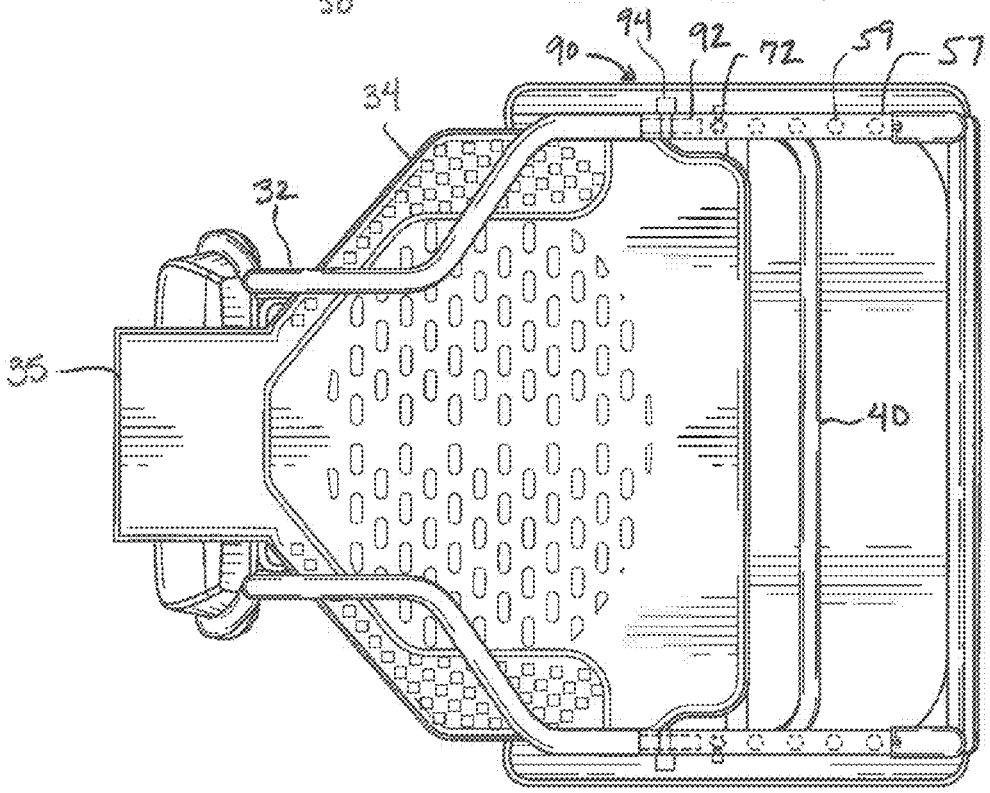

Turning now to FIGS. 7A-7B, yet another embodiment of the desk assembly 10 has a desk 50 and seat 20 integrated into the base 30, but the desk 50 is removable from the base 30 so it can be used independently. The seat 20, base 30, footrest 40, and desk 50 are similar to those discussed above so that similar reference numerals are used. Here, the desk 50 has four legs 52 and 52' and can be independently removed from the base 30. As with the other embodiments, this four-legged desk 50 can quick-disconnect from the base 30 and seat 20 to allow modularity and flexibility for both the user and manufacturer.

As shown, the lower ends of the front legs 52 connect with side members 57 to the lower ends of the back legs 52' on the desk 50. The ends of the frame members 32 abut the ends of these side members 57, and lock mechanisms 90 hold them together. This keeps the desk 50 attached to the integrated seat 20 and base 30 of the assembly 10. As best shown in FIG. 7B, the lock mechanisms 90 can include narrower bars 92 that extend from the frame members 32 and fit into hollow ends of the side members 57. Threaded fasteners or pins 94 installs through the side members 57 and the extending bars 92 to hold the desk 50 to the base 30.

When desired, the lock mechanisms 90 can be unfastened, and the desk 50 can be slid away from the base 30 to remove the desk 50 from the assembly 10. At that point in a manner similar to FIGS. 5A-5B, the desk 50 can be used independently from the base 30 and seat 20, which can also be used independently. For stability and depending on the size of the floor 34 and the distribution of weight, the floor 34 may require an extension 35 beyond the back of the seat 20 to prevent tipping backwards if the seat 20 and base 30 are used without the desk 50. Alternatively, the back ends of the frame members 32 under the seat 20 may have feet, legs, or other feature (not shown) to prevent back tilt.

As also shown in FIGS. 7A-7B, an alternative arrangement can be used to adjust the position of the footrest 40. Here, the side members 57 define various slots 59 along their lengths. Ends of the footrest 40 can position in these top slots 59 across the bottom of the desk 50 to adjust the footrest's position. Locking pins 72 can insert or thread through side holes in the side members 57 to lock against the footrest's ends positioned in the slots 59.

D. Movable Desk and Other Features

Figure 8:
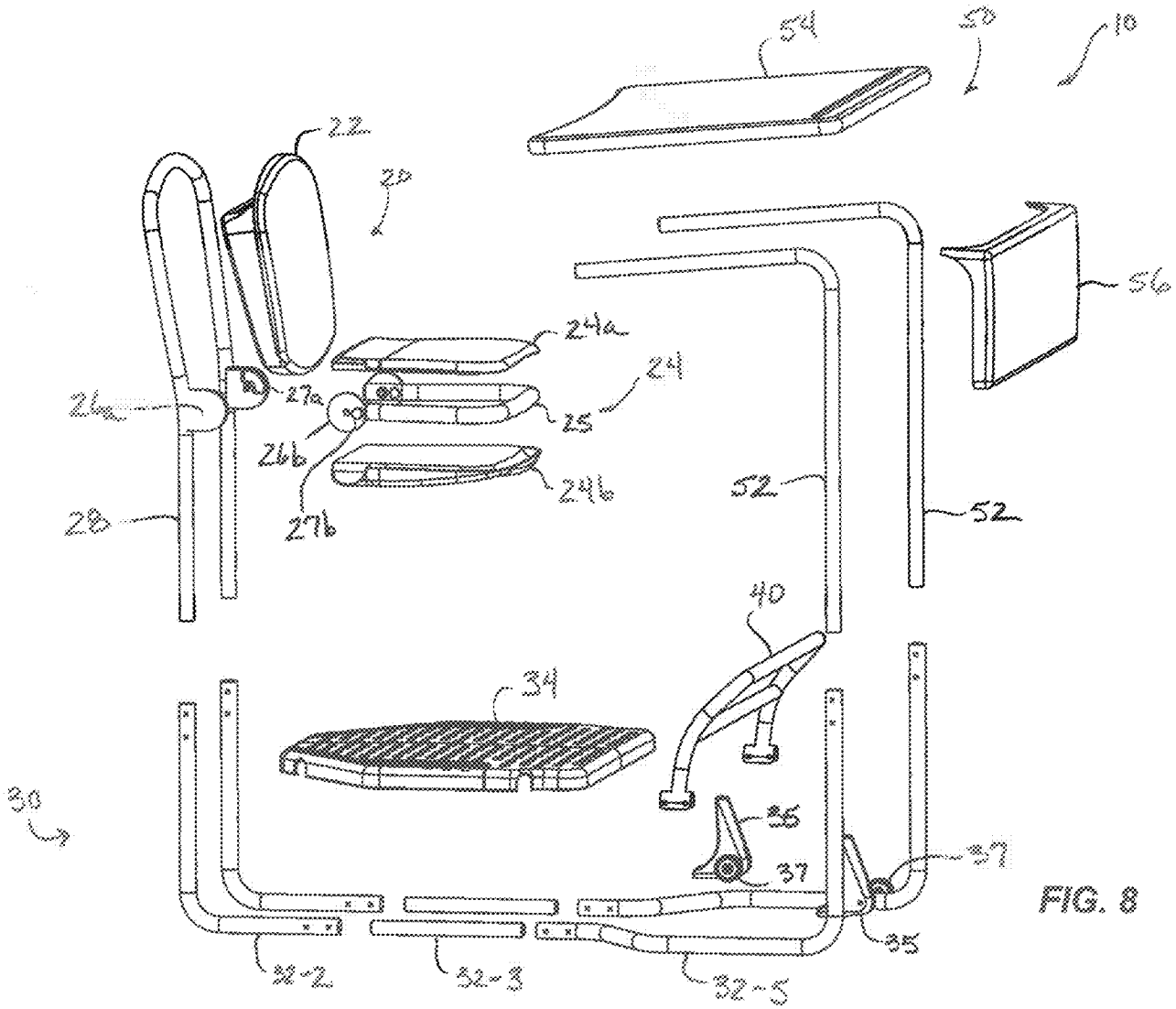
FIG. 8 illustrates an exploded view of an embodiment of a movable desk assembly having an integrated seat, base, and desk.
Figure 9A:
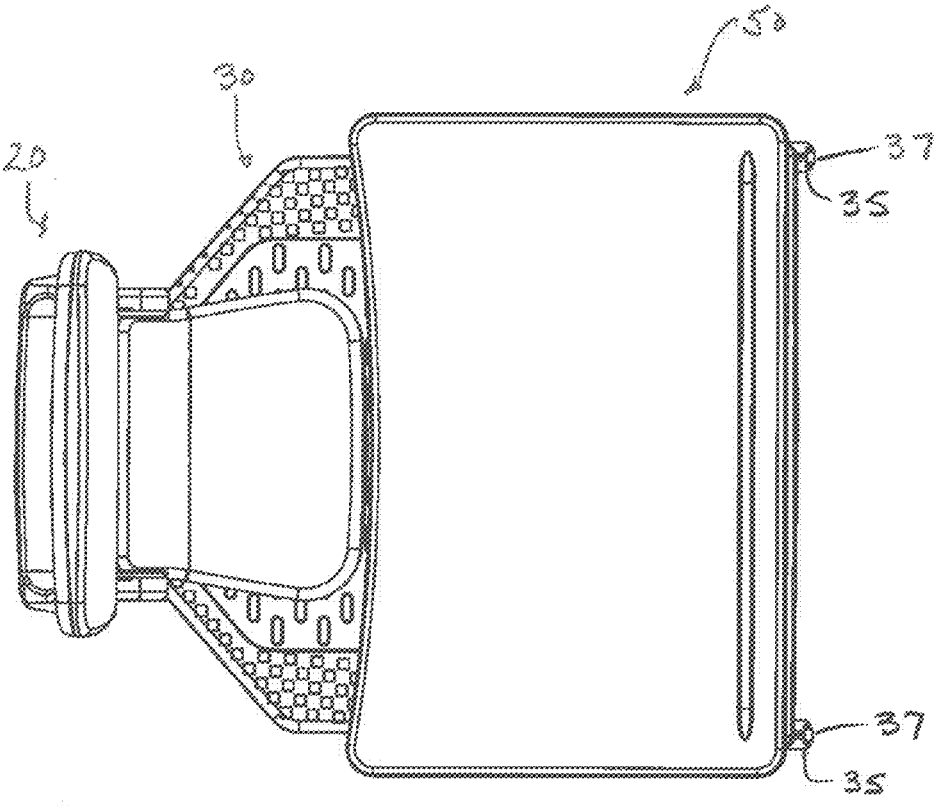
FIGS. 9A-9D illustrate top, side, perspective, and front views of the movable desk assembly of FIG. 8.
Figure 9B:
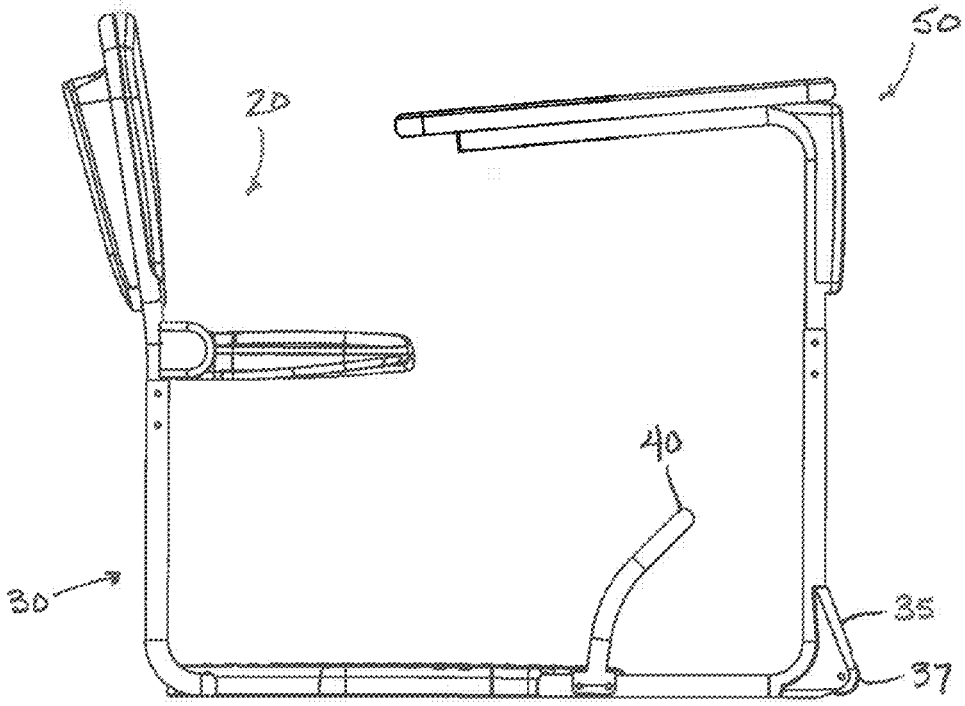
Figure 9C:
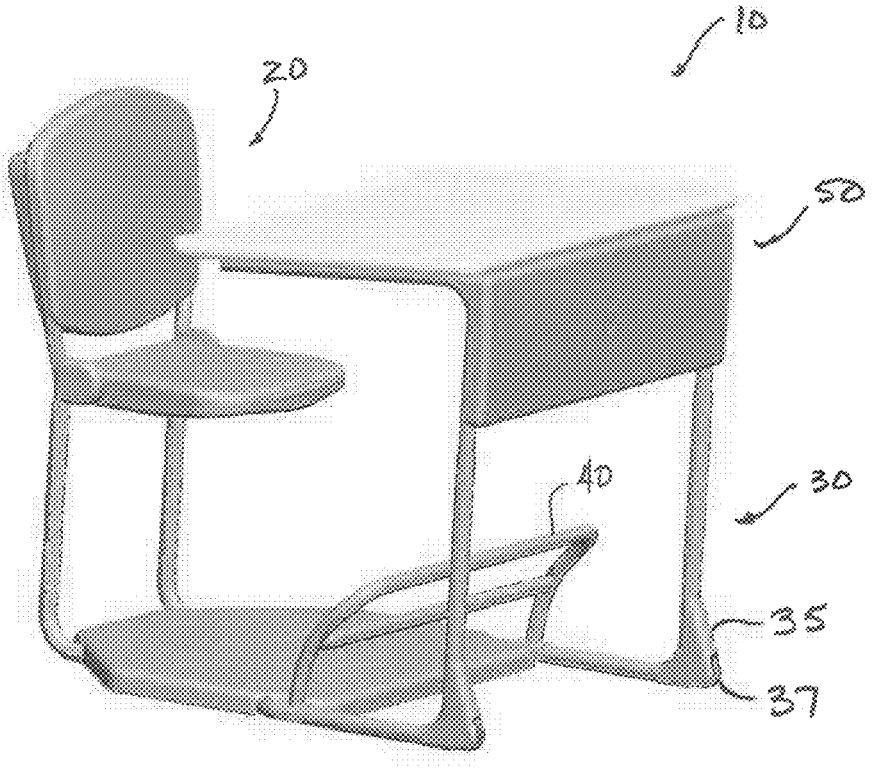
Figure 9D:
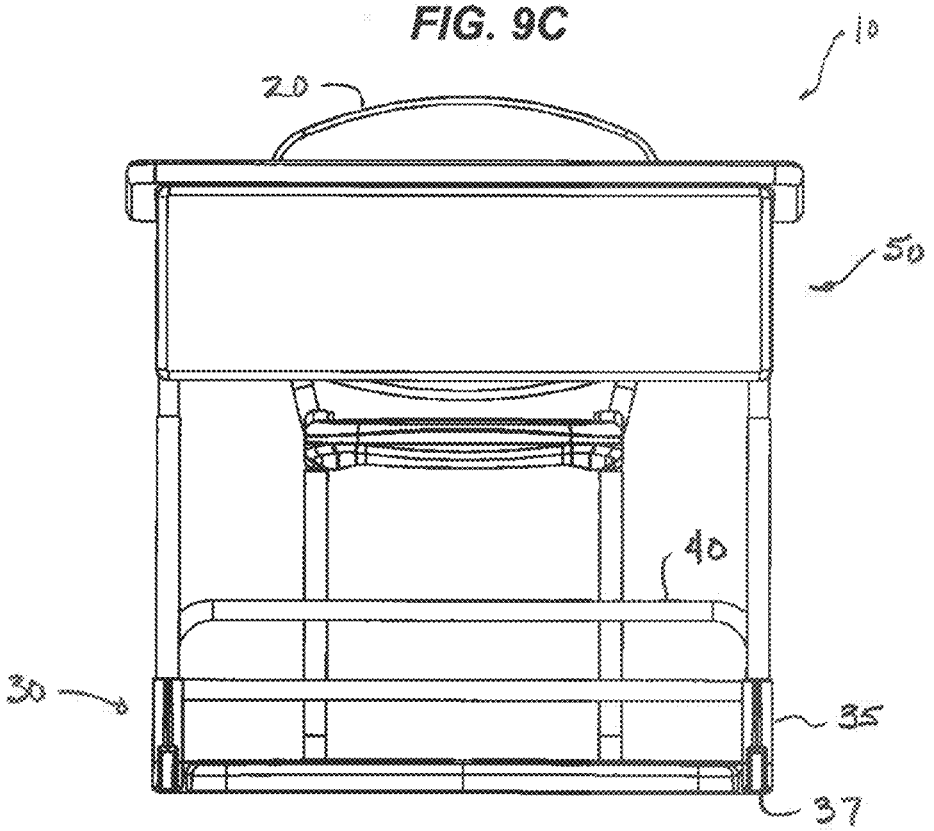

FIG. 8 illustrates an exploded view of an embodiment of a movable desk assembly 10 having a desk 50 with integrated seat 20 and base 30. FIGS. 9A-9D illustrate the assembly 10 in top, side, perspective, and front views. As before, the seat 20, base 30, footrest 40, and desk 50 are similar to those discussed above so that similar reference numerals are used.

As shown, the inside edge of the tabletop 54 is curved, and the back of the seat 20 has a storage compartment. Additional supports can be provided on the back or sides of the seat 20 for a back-pack or a purse.

As best shown in the exploded view of FIG. 8, the frame members 32 can comprise several independent tubular elements 32-2, 32-3, and 32-5 that couple together, either fixedly with screws or adjustably with push-button locks or other mechanism, as disclosed herein. Not only does this arrangement facilitate manufacture of the assembly 10, but the modular construction facilitates the ability to separately disconnect the desk 50 from the frame 30 according to the various embodiments discussed above in FIGS. 4A through 7B.

As also shown in FIG. 8, the bottom rest 24 of the seat 20 has a bottom panel 24*b* affixed to a U-shaped support bar 25 with pivot points 26*b*, which pivotably connect to hinges 26*a* disposed on the seat's back support bar 28. Pins 27*b* on the pivot points 26*b* fit in channels 27*a* on the hinges 26*a* that limit the amount the support bar 25 can pivot. The seat 20 also has a top panel 24*a* that may or may not be attached to the U-shaped support bar 25, depending on whether the seat 20 has a storage space or not, as noted below.

Figure 10:
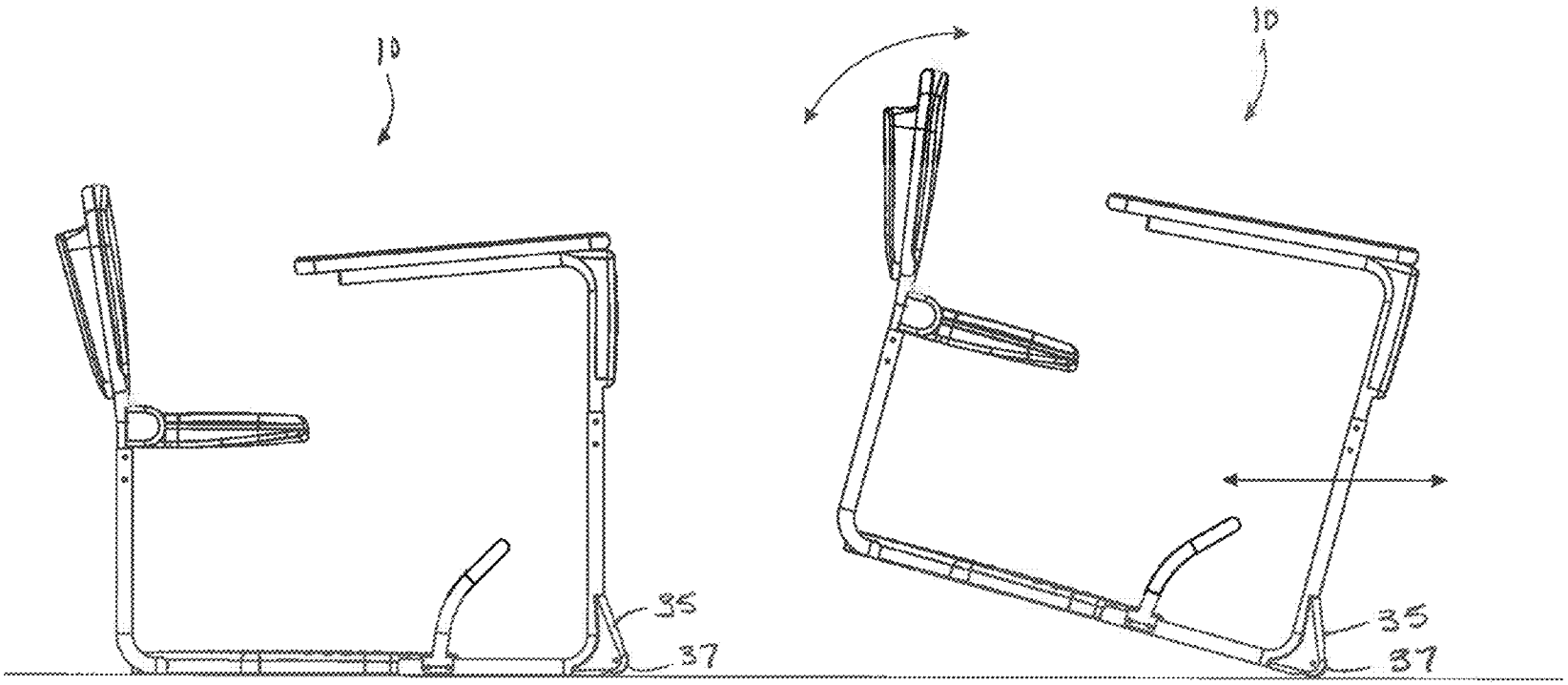
FIG. 10 shows the movable desk assembly of FIG. 8 when stationary and when being moved.

As also shown, feet 35 attach toward the front edges of the frame members 32 and hold rollers or wheels 37. When the assembly 10 rests on the floor as depicted in FIG. 10, the wheels 37 on the feet 35 are held up away from the surface so that the assembly 10 can rest on the floor and remain stationary. However, when the assembly 10 is tilted forward to pivot on the feet 35, a user can move the assembly 10 along the floor using the wheels 37.

In alternative arrangements, the wheels 37 and feet 35 can be disposed on the back edges of the frame members 32 (i.e., beneath the seat 20) or disposed on both the front and back edges. In either case, the wheels 37 are disposed above the floor when the base 30 rests on the floor so the assembly 10 will not move inadvertently. However, the assembly 10 is supported on the wheels 37 against the floor when the assembly 10 is pivoted relative to the floor so the assembly 10 can be moved.

E. Adjustable Components

Figure 11A:
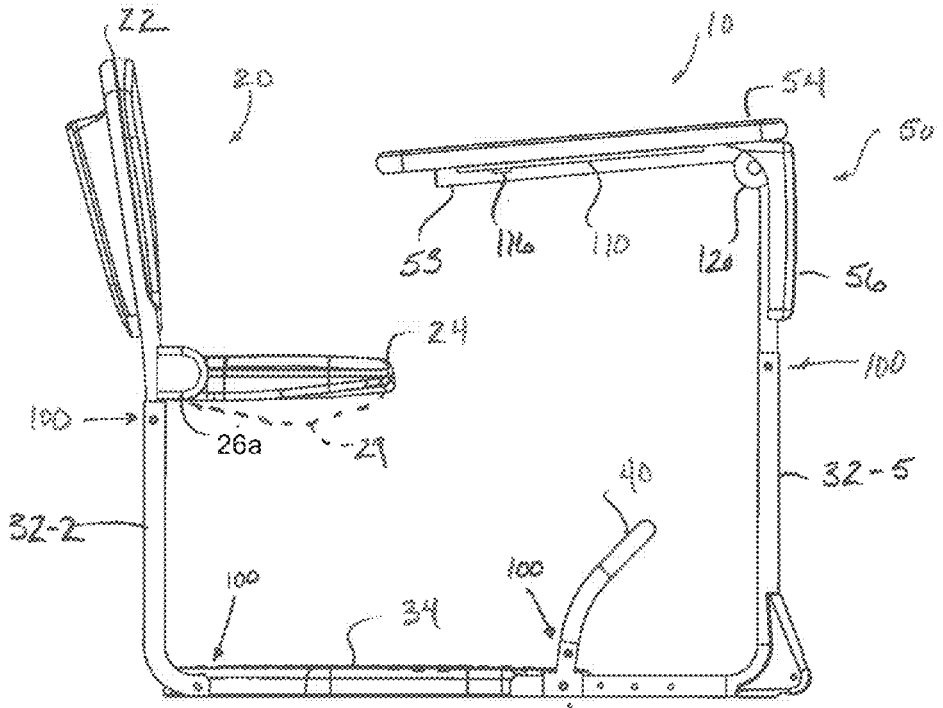
FIGS. 11A-11C illustrate side and bottom views of an embodiment of an integrated desk assembly having adjustable seat and desk components.
Figure 11B:
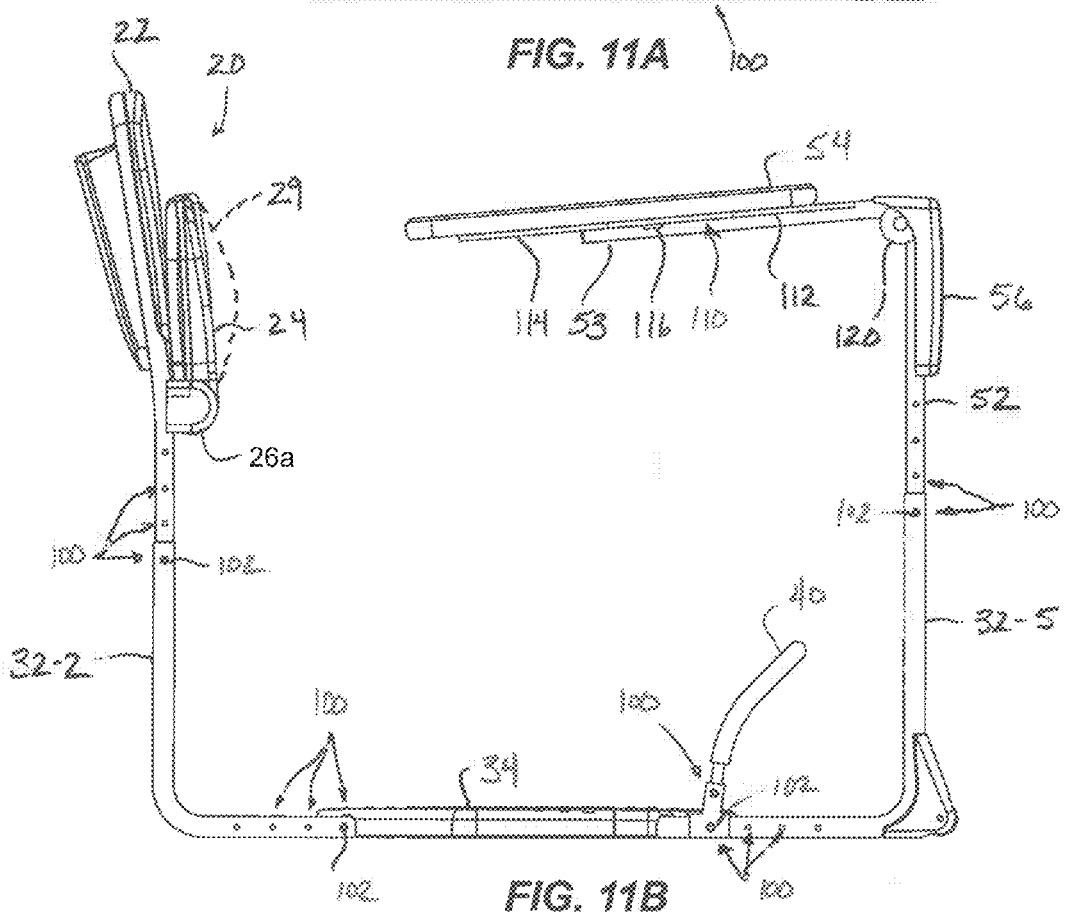
Figure 11C:
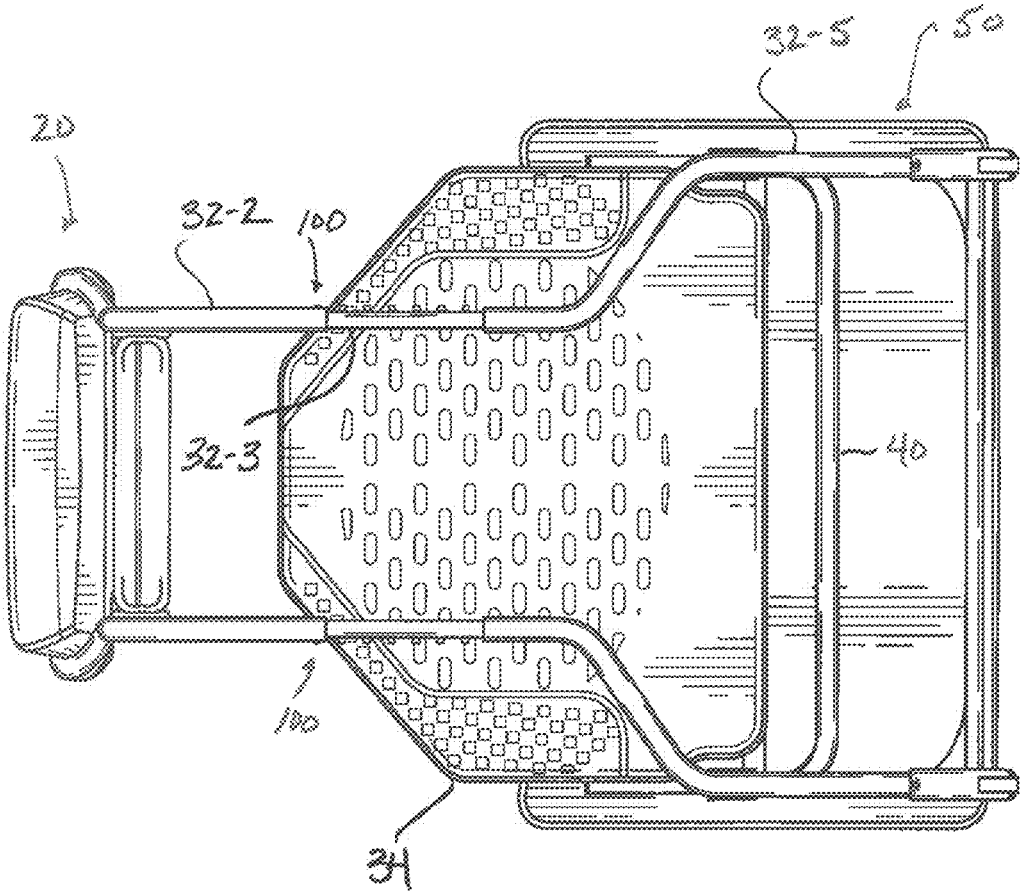

In addition to the desk assembly 10 being movable and having removable components as disclosed above, other embodiments of the assembly 10 can have adjustable components. For example, FIGS. 11A-11C illustrate an embodiment of the assembly 10 having adjustable seat and desk components. In the side view of FIG. 11A, the assembly 10 is shown in its smallest, unextended state. However, in FIG. 11B, the assembly 10 is shown with a number of components adjusted.

As depicted in FIG. 11B, for example, the height of the desk 50 can be adjusted relative to the floor 34. To do this, the legs 52 of the desk 50 can be telescopically disposed in the frame members 32-5, and an adjustment mechanism 100, such as push-button locks or other mechanisms, on the legs 52 can be successively locked in lock holes 102 on the frame members 32-5. In a similar fashion, the height of the seat 20 can be adjusted by having the seat legs 28 telescopically disposed in the frame members 32-2 with adjustment mechanisms 100 for locking in holes 102 at particular adjusted positions.

The depth of the seat 20 (i.e., the distance of the seat from the desk 50) can be adjusted as well. As best shown in the bottom view of FIG. 11C, the frame members 32 can be separated into seat members 32-2 and desk members 32-5. One of these members (e.g., 32-2) can be telescopically disposed over intermediate bars 32-3, which may be fixedly attached to the other member (e.g., 32-5). The intermediate bars 32-3 have adjustment mechanisms 100 that can lock in holes in the movable members (32-2). This allows the seat members 32-2 to be pulled away from the base 30 or pushed toward the base 30 to adjust the depth of the seat 20.

Although not specifically shown, the desk 50 instead of or in addition to the seat 20 can having its depth adjusted relative to the base 30. This depth adjustment of the desk 50 can be achieved using a similar arrangement as provided for the depth adjustment of the seat 20 so the details are not repeated here, but would be apparent with the benefit of the present disclosure.

Additionally as shown in FIGS. 11A-11B, the tabletop 54 of the desk 50 can move on sliding tracks 110 back and forth to adjust the tabletop's 54 position. Each sliding track 110 can have longitudinal rails 112 and 114—one rail 114 riding in a channel of the other rail 112 and using bearings or the like to facilitate sliding. Preferably, a catch, stop, or lock 116 can lock the position of the sliding track 110 at least in its two extreme positions, if not more. The tabletop 54 can also be tilted by providing a locking hinge mechanism 120 at the corner between the legs 52 and the supports bars 53 on the underside of the tabletop 54.

As further depicted in FIGS. 11A-11C and as noted above with reference to FIG. 8, the seat 20 has a retractable bottom support 24 that can be pivoted on hinges 26*a* up against the seat back 22. This can allow the user to stand on the floor 34 of the base 30 using it as a standing deck. Finally, not only can the depth of the footrest 40 be adjusted as noted above, but the footrest 40 can be adjusted for height using an adjustment mechanism 100 similar to those disclosed herein, such as a push-button lock mechanism or the like.

F. Seat Pan Lumbar Support

Figure 12A:
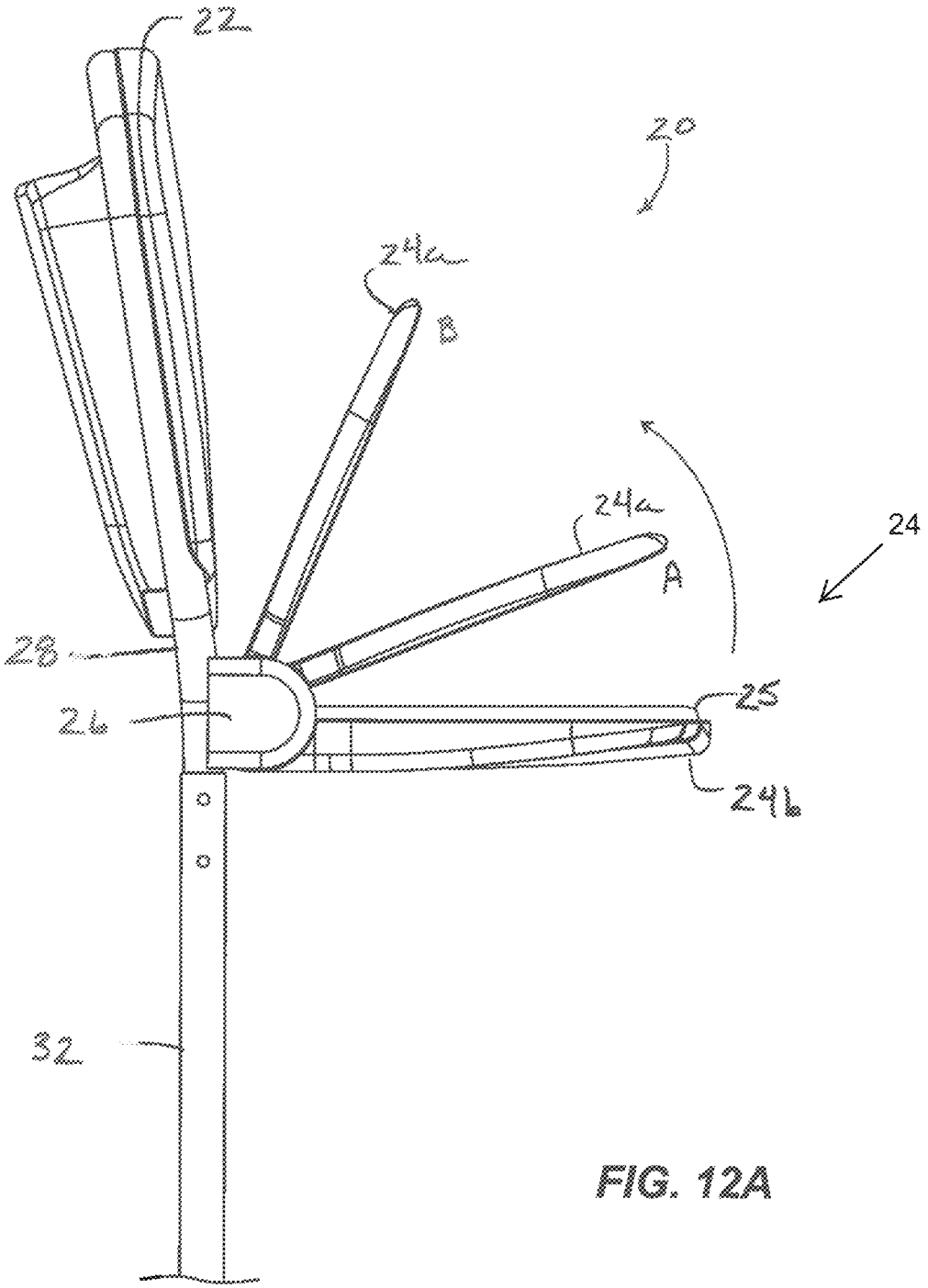
FIG. 12A illustrates a seat for the disclosed assembly in stages of use.

As shown previously in FIG. 8, the bottom rest 24 of the seat 20 has a bottom panel 24*b* affixed to a U-shaped support bar 25 with pivot points 26*b* pivotably connected to hinges 26*a* disposed on the seat's back support bar 28. Pins 27*b* on the pivot points 26*b* fit in channels 27*a* on the hinges 26*a* that limit the amount the support bar 25 can pivot. The seat 20 also has a top panel 24*a* that may or may not be attached to the U-shaped support bar 25. Although the seat's bottom rest 24 can be pivoted entirely on the hinges 26*a* as shown in FIG. 11B, the top panel 24*a* can pivot separately on the hinges 26*a* toward the back panel 25. For example, FIG. 12A depicts different stages (A and B) of the top panel 24*a* pivoted separately. When this top panel 24*a* is pivoted by itself, the bottom panel 24*b* and support bar 25 can form a storage space in the seat bottom rest 24.

Figure 12B:
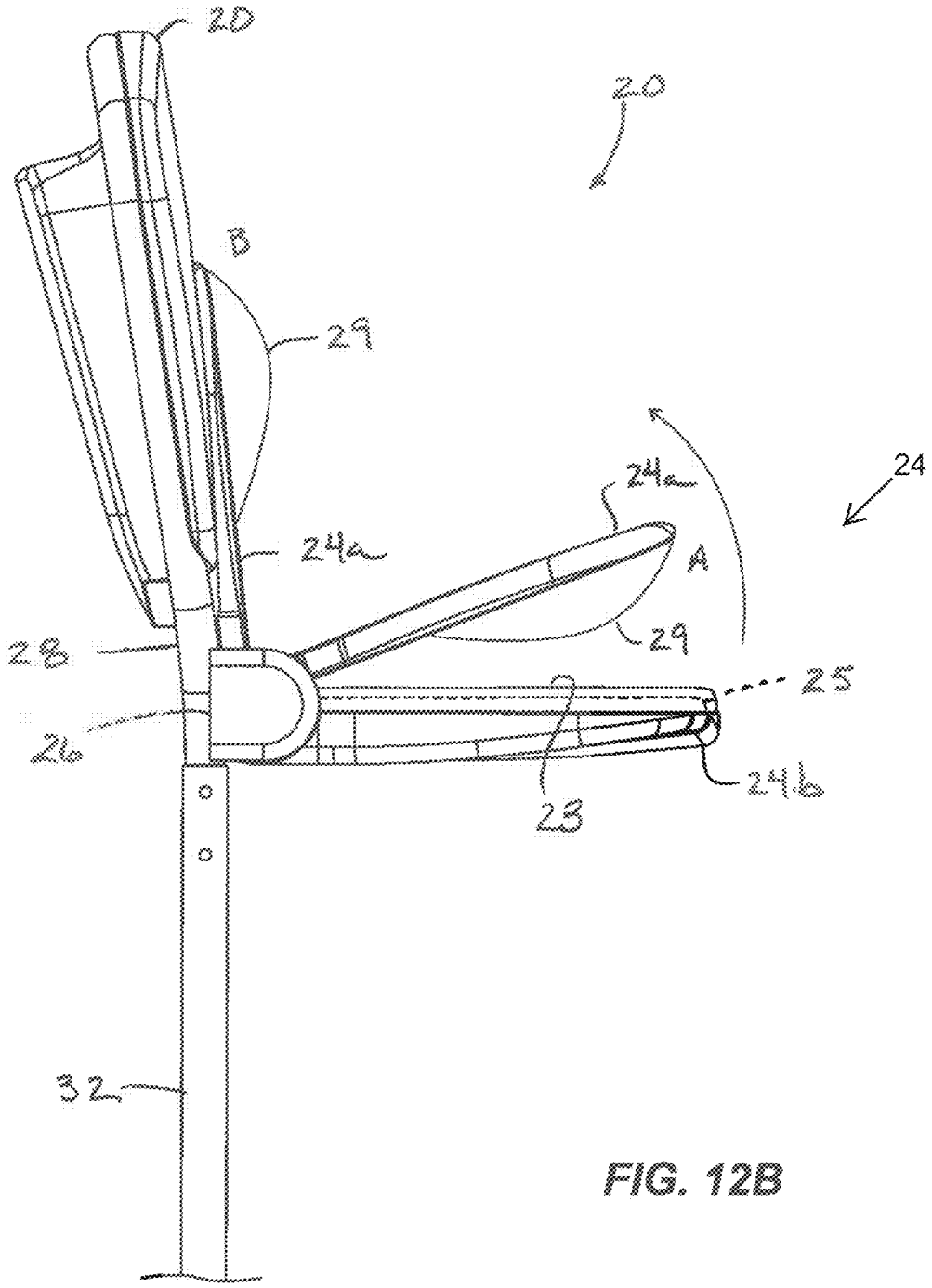
FIG. 12B illustrates a seat for the disclosed assembly in stages of use and having a lumbar support.

FIG. 12B illustrates another seat 20 for the disclosed assembly in stages of use (A and B). As noted above in FIGS. 8 and 12A and shown again, the bottom rest 24 of the seat 20 has a bottom panel 24*b* affixed to a U-shaped support bar 25 with pivot points (26*b*: FIG. 8) pivotably connected to hinges 26*a* disposed on the seat's back support bar 28. Pins (27*b*: FIG. 8) on the pivot points (26*b*) fit in channels (27*a*: FIG. 8) on the hinges 26*a* that limit the amount the support bar 25 can pivot. The seat 20 also has a top panel 24*a* that is not attached to the U-shaped support bar 25. The top panel 24*a* can pivot separately on the hinges 26*a*.

Rather than forming a storage space, however, the bottom panel 24*b* and support bar 25 in FIG. 12B have a cushion 23 or form another panel surface on which a user can sit. The inside surface of the top panel 24*a* has a shaped surface 29 forming a lumbar support for a seated user. The lumbar support 29 can include padding affixed to the inside of the top panel 24*a* or can simply be a molded shape integrated into the material (i.e., plastic) of the seat's top panel 24*a*.

In yet another alternative and instead of or in the alternative to the lumbar support 29 disposed on the inside of the top panel 24*a*, the bottom surface of the bottom panel 24*b* may have such a lumbar support (e.g., 29 depicted in dashed line in FIG. 11B). Therefore, when the entire bottom support 24 of the seat 20 is pivoted up against the back support 22 as shown in FIG. 11B, the lifted bottom support 24 up against the back support 22 can allow a user to stand on the floor as a standing platform, while the lumbar support (29) on the bottom surface of the pivoted bottom support 24 can provide a lumbar support curve positioned for leaning support of the user's lower-back while standing.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Thus, a desk assembly according to the present disclosure can have one or more of an information panel, removable desk, removable seat, wheels, seat panel with integrated lumbar support, pivotable seat bottom, adjustable desk, adjustable seat, adjustable, footrest, adjustable tabletop, or other feature disclosed herein.

Moreover, various adjustment mechanisms have been described for adjusting the length of frame components. For example, adjustment mechanisms have been described for locking telescopically disposed sections of tubing in adjusted positions. Any known lock mechanism for telescopic tubing can be used, including, but not limited to, push-button lock mechanisms, through pins, ratchet mechanisms, holes and removable fasteners, and the like. For example, ratchet mechanisms can be used for adjusting telescopic tubing that allow one tube to be pulled out of the other in one direction, but a ratchet prevents reinsertion. Instead, the tubes must be pulled to a specific length before the ratchet mechanism will allow reinsertion. In another example, compression or clenching collars can be used to lock the tubes in position using friction, much in the same way the leg sections for tripods are locked. These and other forms of adjustment mechanisms can be used on the discloses assemblies.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly, comprising:

a desk disposed on the assembly;

a seat disposed on the assembly adjacent the desk; and a base disposed on the assembly and interconnecting the seat to the desk, wherein the seat comprises a bottom support having top and bottom surfaces and being pivotable from a seating position to a standing position, the top surface of the bottom support in the seating position providing support to a user seated on the seat, the bottom support pivoting upward from the seating position to the standing position, the bottom surface of the bottom support in the standing position accommodating the user standing on the base between the desk and the seat.

2. The assembly of claim 1, wherein the base has a removable connection to legs of the seat, and wherein the seat and the desk are both self-supporting when the seat is disconnected from the removable connection to the base.

3. The assembly of claim 1, wherein the base disposed on the assembly interconnects the seat at a first distance to the desk, the assembly comprising:

a footrest disposed on the base; and an adjustable connection between the footrest and the base and adjusting position of the footrest along the first distance relative to the seat.

4. The assembly of claim 1, wherein the desk comprises a desktop having a front edge; vertical supports depending from the front edge of the desktop and supporting the desktop; and at least one of a screen, a panel, a frame, and a placard affixed across the front edge of the desktop between the vertical supports.

5. The assembly of claim 1, comprising: wheels disposed on either front or back edges of the base, the wheels disposed above a floor when the base rests on the floor, the assembly supported on the wheels against the floor when the assembly is pivoted relative to the floor.

6. The assembly of claim 1, comprising: an adjustable connection of the seat to the base and adjusting a distance of the seat from the desk.

7. The assembly of claim 1, wherein the seat comprises a back support for providing back support to the user when seated on the seat.

8. The assembly of claim 1, wherein the bottom surface of the bottom support pivoted upward from the seating position to the standing position provides back support to the user when standing on the base between the desk and the seat.

9. The assembly of 8, wherein the bottom support comprises a lumbar support disposed on the bottom surface of the bottom support, the lumbar support on the bottom support pivoted upward from the seating position to the standing position providing the back support to the user when standing on the base between the desk and the seat.

10. The assembly of claim 2, wherein the base disposed on the assembly interconnects the seat at a first distance to the desk, the assembly comprising:

a footrest disposed on the base; and an adjustable connection between the footrest and the base and adjusting position of the footrest along the first distance relative to the seat.

11. The assembly of claim 2, wherein the desk comprises a desktop having a front edge; vertical supports depending from the front edge of the desktop and supporting the desktop; and at least one of a screen, a panel, a frame, and a placard affixed across the front edge of the desktop between the vertical supports.

12. The assembly of claim 2, comprising wheels disposed on either front or back edges of the base, the wheels disposed above a floor when the base rests on the floor, the assembly supported on the wheels against the floor when the assembly is pivoted relative to the floor.

13. The assembly of claim 1, wherein the base has a removable connection to the desk, and wherein the seat and the desk are both self-supporting when the desk is disconnected from the removable connection to the base.

14. The assembly of claim 13, wherein the base disposed on the assembly interconnects the seat at a first distance to the desk, the assembly comprising:

a footrest disposed on the base; and an adjustable connection between the footrest and the base and adjusting position of the footrest along the first distance relative to the seat.

15. The assembly of claim 13, wherein the desk comprises a desktop having a front edge; vertical supports depending from the front edge of the desktop and supporting the desktop; and at least one of a screen, a panel, a frame, and a placard affixed across the front edge of the desktop between the vertical supports.

16. The assembly of claim 13, comprising wheels disposed on either front or back edges of the base, the wheels disposed above a floor when the base rests on the floor, the assembly supported on the wheels against the floor when the assembly is pivoted relative to the floor.

17. The assembly of claim 13, comprising an adjustable connection of the seat to the base and adjusting a distance of the seat from the desk.

* * * * *